US006953388B2

(12) United States Patent
Shimagaki et al.

(10) Patent No.: US 6,953,388 B2
(45) Date of Patent: Oct. 11, 2005

(54) POLISHING PAD, AND METHOD AND APPARATUS FOR POLISHING

(75) Inventors: Masaaki Shimagaki, Otsu (JP); Hisashi Minamiguchi, Otsu (JP); Masami Ohta, Moriyama (JP)

(73) Assignee: Toray Industries, Inc. (JP)

( * ) Notice: Subject to any disclaimer, the term of this patent is extended or adjusted under 35 U.S.C. 154(b) by 5 days.

(21) Appl. No.: 10/168,664

(22) PCT Filed: Dec. 18, 2000

(86) PCT No.: PCT/JP00/08941

§ 371 (c)(1),
(2), (4) Date: Jun. 21, 2002

(87) PCT Pub. No.: WO01/45899

PCT Pub. Date: Jun. 28, 2001

(65) Prior Publication Data

US 2003/0003857 A1 Jan. 2, 2003

(30) Foreign Application Priority Data

Dec. 22, 1999 (JP) ..... 11-364015
Jun. 21, 2000 (JP) ..... 2000-185765
Jun. 21, 2000 (JP) ..... 2000-185766

(51) Int. Cl.[7] ..... B24B 1/00

(52) U.S. Cl. ..... 451/41; 451/526; 451/533; 51/295; 51/298; 438/691

(58) Field of Search ..... 451/41, 285, 287, 451/288, 526, 527, 533; 428/147; 438/691, 692; 51/295, 298, 296

(56) References Cited

U.S. PATENT DOCUMENTS 4,581,287 A * 4/1986 Smith et al. ..... 428/290
5,578,362 A 11/1996 Reinhardt et al.
6,180,020 B1 * 1/2001 Moriyama et al. ..... 216/88
6,337,281 B1 * 1/2002 James et al. ..... 438/693
6,364,749 B1 * 4/2002 Walker ..... 451/41

FOREIGN PATENT DOCUMENTS

| | | |
|---|---|---|
| JP | 3198332 | 8/1991 |
| JP | 6208980 | 7/1994 |
| JP | 7061609 | 7/1995 |
| JP | 11077517 | 3/1999 |
| JP | 11090809 | 4/1999 |
| JP | 2000-033552 | 4/1999 |
| JP | 11138422 | 5/1999 |
| JP | 2000-034416 | 5/1999 |
| JP | 11-156701 | 6/1999 |

* cited by examiner

*Primary Examiner*—Eileen P. Morgan
(74) *Attorney, Agent, or Firm*—DLA Piper Rudnick Gray Cary US LLP

(57) ABSTRACT

A polishing pad characterized by having a mechanism for supplying water to the plane of the polishing pad in contact with the article to be polished, in particular, in case the mechanism comprises a domain structure having an area of $1\times10^{-6}$ $m^2$ or smaller, reduces the generation of scratches and the dust adhesion on the surface of the article to be polished, while increasing polishing rate at low dishing and erosion; hence, the product is applicable to the field of surface polishing of semiconductor thin films.

25 Claims, 1 Drawing Sheet

POLISHING PAD, AND METHOD AND APPARATUS FOR POLISHING

TECHNICAL FIELD

The present invention relates to a polishing pad for use in chemical mechanical polishing (CMP), in which the article to be polished is pressed against a rotating elastic pad to thereby establish relative motion while supplying thereto a polishing liquid containing processing abrasives or a polishing liquid free from abrasives, thereby preferentially polishing the protruded portion of an irregular surface of the article to be polished with an abrasive; the invention also relates to a polishing apparatus and polishing method using the same.

BACKGROUND ART

In producing a semiconductor having highly increased degree of integration, the surface of the dielectric film should be completely planarized to realize multilayer wiring. As representative techniques of planarization known heretofore, studies have been made on, for instance, SOG (Spin-On-Glass) process, etch-back process (P. Elikins, K. Reinhardt, and R. Layer, "A planarization process for double metal CMOS using Spin-on Glass as a sacrificial layer", Proceeding of 3rd International IEEE VMIC Conf., 100 (1986)), and lift-off process (K. Ehara, T. Morimoto, S. Muramoto, and S. Matsuo, "Planar Interconnection Technology for LSI Fabrication Utilizing Lift-off Process", J. Electrochem. Soc., Vol.131, No.2, 419 (1984)).

Concerning the SOG process, although this is a planarization process utilizing the fluidity of the SOG film, the film itself is impossible to realize complete planarization. The etch-back process is the most widely employed technique; however, this process suffers the problem of generating dust on etching the resist and the dielectric film at the same time, and is not an easy technique concerning the point of dust control. In the lift-off process, the stencil material used cannot be completely dissolved on lift-off, and this leads to the generation of a problem of not realizing lifting off. Hence, this process is not put into practice due to incomplete controllability and production yield.

In the light of the aforementioned circumstances, CMP method is being attracting attention. This process comprises preferentially polishing the protruded portion of an irregular surface of the article to be polished with an abrasive by pressing the article to be polished against a rotating elastic pad, to thereby establish relative motion while supplying thereto a polishing liquid containing processing abrasives or a polishing liquid free from abrasives, and this process is widely employed thanks to the simplicity of the process.

For instance, Japanese Patent Laid-Open No. 11050/1996 discloses a polishing cloth characterized in that it comprises parts differing in surface hardness are formed by utilizing phase separation of a resin. However, the problems of scratches and dust adhesion remain to be solved. Furthermore, this process suffers the disadvantage that the homogeneous processing is difficult with respect to the thickness direction of the polishing cloth.

Further recently, fine irregularities that are present on the semiconductor wafer itself before subjecting it to the surface roughening process, i.e., those expressed as waviness, nanotopology and the like, which were conventionally unknown as problems, are now regarded problematic, and hence, practiced at present are the double face polishing, a process of carrying out polishing while flowing an alkali, and the like. However, in the CMP processes above, there are mentioned problems occurring on the surface of the article to be polished, such as the scratches, adhesion of dust, incomplete global planarity, and the like.

The polishing pads can be roughly classified into polishing pads for use in a conventional CMP in which polishing is carried out while supplying a polishing liquid containing abrasives (which is simply referred to hereinafter as "polishing pad" unless particularly specified), and pads with fixed abrasives, in which polishing is carried out while supplying a polishing liquid free of abrasives.

As common problems to be solved for the two types of pads above, there can be mentioned the generation of scratches and the adhesion of dust.

With respect to the so-called dishing and erosion on polishing, it is said that pads with fixed abrasives are superior, however, the problems of the scratches and the adhesion of dust that generate on the surface of the article to be polished remain unsolved.

In case the adhesion of dust or scratches generate on the polishing surface of, for instance, interlayer dielectric film and the like, step failure and the like may generate on forming interconnection using an Al based metal and the like in the later process, and this may lead to the generation of a problem of causing loss of reliability, such as the degradation in the resistance against electromigration. Otherwise, on polishing a non-magnetic substrate for HDD (Hard Disk Drive) and the like, this causes a drop in reproduced signals, such as dropouts. The generation of scratches are believed to be attributed to the agglomerates due to poor dispersion of abrasives. In particular, the polishing slurry using alumina as the abrasive grains, which is employed in the CMP of metallic films, suffers poor dispersibility, and is far from complete in preventing scratches from generating. Concerning dust adhesion, even the cause thereof is yet unknown.

In common sense, the use of a hard polishing pad is preferred for improving global planarity; however, since dust adhesion or scratches tend to form more easily by the use of such hard polishing pad, it is believed impossible to satisfy both requirements at the same time. For instance, although such attempts are disclosed in International Patent Publication No. 500622/1996 or in Japanese Patent Laid-Open No. 2000-34416, prevention of dust adhesion and scratches is not concurrent with the planarization characteristics.

In the light of such circumstances, an object of the present invention is, particularly, to reduce dust adhesion on the surface of the polished article. Another object of the present invention is to reduce the generation of scratches, while yet achieving favorable planarization characteristics at the same time.

Furthermore, another object is to remove, by a simple polishing method, fine irregularities of the semiconductor wafer itself before subjecting it to the surface roughening process, i.e., those expressed as waviness, nanotopology and the like.

DISCLOSURE OF THE INVENTION

The present invention comprises constitutions as follows.

(1) A polishing pad characterized by that it comprises a mechanism for supplying water to the plane of the polishing pad in contact with the article to be polished.

(2) A polishing pad as described in (1) above, wherein the mechanism for supplying water is characterized in that it comprises a domain structure having an area of $1\times10^{-6}$ $m^2$ or smaller.

(3) A polishing pad as described in (1) or (2) above, wherein the mechanism for supplying water is characterized in that it is hydrophilic, and that it has a complex structure comprising a substantially water-insoluble polymer and a resin matrix.

(4) A polishing pad as described in (3) above, wherein the polymer substantially insoluble to water is characterized in that it comprises hydrophilic organic particles and/or fibrous material having a water absorptivity of 5000% or lower.

(5) A polishing pad as described in (4) above, wherein said particles and/or fibrous material are characterized in that they are mixed in such a manner to account for 4 wt. % or higher but not higher than 60 wt. %.

(6) A polishing pad as described in (3) above, wherein the hydrophilic polymer substantially insoluble to water is characterized in that it is a sheet-like material, and comprises a laminate of a complex structure with an organic polymer matrix.

(7) A polishing pad as described in (6) above, wherein the sheet-like material is characterized in that it comprises at least one of non-woven-like, textile-like, woven-like, felt-like, porous membrane-like, film-like, and sponge-like sheet.

(8) A polishing pad as described in (6) or (7) above, wherein the layers constituting the laminate are characterized in that each has a thickness of 1 $\mu$m or more.

(9) A polishing pad as described in (6) to (8) above, wherein the pad is characterized in that the resin content and/or the type of the resin of the resin matrix differs from layer to layer.

(10) A polishing pad as described in (6) to (9) above, wherein the pad is characterized in that the thickness and/or the type of the sheet-like material differs from layer to layer.

(11) A polishing pad as described in (6) to (10) above, wherein it is characterized in that the sheet-like material accounts for 3 wt. % or more.

(12) A polishing pad as described in (3) above, wherein the hydrophilic polymer substantially insoluble to water is characterized in that it comprises a fibrous material having an aspect ratio of 5 or higher and/or particles formed from the composite thereof.

(13) A polishing pad as described in (3) to (12) above, wherein the hydrophilic polymer substantially insoluble to water is characterized in that it has nominal water content of 3% or higher.

(14) A polishing pad as described in (3) to (13) above, wherein it is characterized in that, on taking the centerline average roughness Ra of a single silicon wafer having provided with an oxide film after polishing, the difference in value of Ra falls in a range of 0.2 $\mu$m or less with respect to the surface roughness profile generated by dressing before polishing taken as the standard.

(15) A polishing pad as described in (3) to (13) above, wherein the hydrophilic polymer substantially insoluble to water is characterized in that it is mixed in such a manner substantially free from interstices.

(16) A polishing pad as described in (1) to (15) above, wherein the matrix constituting the pad is characterized in that it is made of a thermosetting resin.

(17) A polishing pad as described in (3) to (16) above, wherein the pad is characterized in that it has interstices in addition to the hydrophilic polymer substantially insoluble to water.

(18) A polishing pad as described in (1) to (17) above, wherein the pad is characterized in that it comprises inorganic fine particles.

(19) A polishing pad as described in (18) above, wherein the pad is characterized in that it comprises organic-inorganic nanocomposite and/or barium carbonate particles.

(20) A polishing pad as described in (18) or (19) above, wherein the organic-inorganic nanocomposite is characterized in that it is at least one selected from a combination of a phenolic resin and silica particles, a combination of an epoxy resin and silica particles, and a combination of a polyamide resin and silica particles.

(21) A polishing pad as described in (1) to (20) above, wherein the pad is characterized in that it further comprises a water-soluble substance.

(22) A polishing pad as described in (21) above, wherein the pad is characterized in that the water-soluble substance accounts for 0.01 wt % to 10 wt %.

(23) A polishing pad as described in (1) to (22) above, wherein the pad is characterized in that it yields a D hardness of 65 or higher.

(24) A polishing pad as described in (1) to (23) above, wherein the pad is characterized in that it yields a flexural modulus of elasticity of 0.5 GPa or higher but not higher than 100 GPa.

(25) A polishing pad as described in (1) to (24) above, wherein the pad is characterized in that it yields a one-hour water absorptivity of 0.8% or higher but not higher than 15%.

(26) A polishing pad as described in (1) to (25) above, wherein the pad is characterized in that the water absorption rate within 5 minutes from contact with water is 3%/hr or higher.

(27) A polishing apparatus characterized in that it used a polishing pad described in one of 1 to 26 described above.

(28) A polishing method characterized in that it used a polishing pad described in one of 1 to 26 described above.

(29) A method for producing a semiconductor wafer or a semiconductor chip, characterized in that processing is carried out by using a polishing pad described in one of 1 to 26 described above.

BEST MODE FOR CARRYING OUT THE INVENTION

Figure 1:
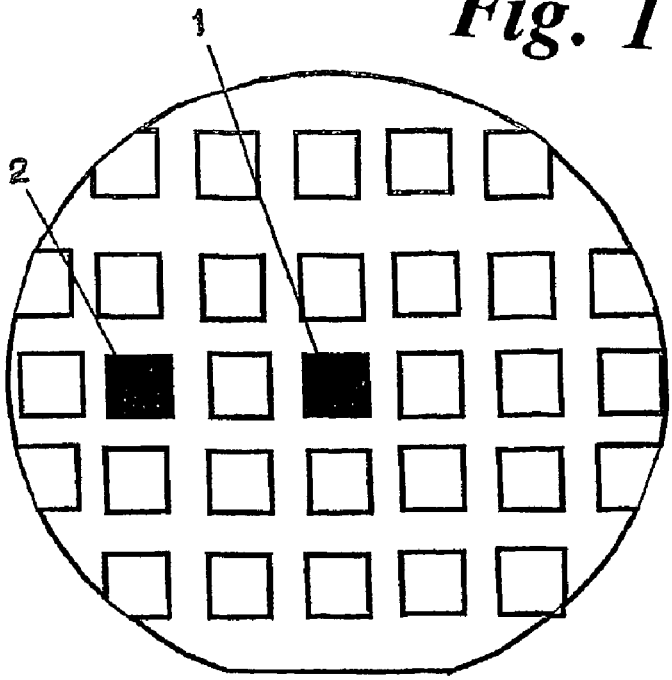
FIG. 1 is a diagram showing a 4-inch diameter wafer provided with an oxide film.

The polishing pad according to the present invention comprises a mechanism for supplying water to the interface that is formed between the pad and the article to be polished being pressed against the pad.

The domain structure as referred in the present invention is a physical structure and/or a chemical structure, which, in case the polishing pad is pressed against the article to be polished, maintains a water layer in the interface. As a matter of course, the domain structure may be a single physical structure. By having such a mechanism, the adhesion of dust to the surface of the article to be polished can be minimized. Concerning the size of the domain in this mechanism, a larger domain is better, however, too large a domain excessively decreases the mechanical strength of the pad surface as a polishing pad as to considerably decrease the durability when polishing, and this leads to a new problem of making it difficult to sufficiently achieve the desired polishing rate. The threshold value for the size differs depending on the resin mainly constituting the pad, however, it has been found that this disadvantage can be circumvented by setting the area to $1\times10^{-6}$ $m^2$ or smaller. The polishing characteristics are not particularly affected by whether the domain size is large or small; however, from the viewpoint of shapability of the polishing pad and of the difficulty in suppressing the fluctuation in quality, the domain size is preferably $1\times10^{-14}$ $m^2$ or larger. It is one solution to establish a so-called microscopic phase separation structure, but it is difficult to maintain the same state for the surface and the inside of the polishing pad, and hence, it is extremely difficult to control the micro phase separation structure over the entire film thickness. Accordingly, there may be employed a simple method as such using two types or more of polymers belonging in an immiscible system, in which the surface of the polymer in charge of the mechanism for supplying water to the interface is modified in such a manner to achieve good affinity with the other polymers, and the polymer is dispersed in microscopic level. As a matter of course, the present invention may be utilized more conveniently by employing a combination of polymers in which there is no need of improving the affinity.

The ratio of the aggregate of the domain structure accounting in the surface of the polishing pad, i.e., the surface density, differs depending on the matrix. In case a polyamide resin or polyurethane resin having high water absorptivity is used, the usage thereof can be set small, but in case a polyacrylic resin such as polymethyl methacrylate or a polyimide is used, the ratio thereof must be set high. In general, the preferred ratio is in a range of from 5% to 50%, however, the optimal value should be set properly depending on the combination of the resins. This process can be readily practiced by those in the art. In case the surface density is set high, the resulting polishing pad tends to yield weaker mechanical properties and becomes brittle, and it tends to yield inferior polishing properties as to easily cause, for instance, dishing and erosion.

The shape of the hydrophilic polymer is preferably provided in particles, non-woven, or textiles from the viewpoint of ease in handling. The particles are preferably 500 $\mu$m or less in diameter, and more preferably, those 100 $\mu$m or less in diameter are used. Those too large in diameter are not preferred, because they tend to cause frequent drop out from the matrix. The fibers constituting the non-woven or textiles may be hollow fibers, although there may be found difficulties in controlling the intrusion of matrix inside the hollow portion.

The ratio of the hydrophilic polymer accounting in the surface of the polishing pad, i.e., the surface density, differs depending on the matrix. In case a polyamide resin or polyurethane resin having high water absorptivity is used, the usage thereof can be small, but in case a polyacrylic resin such as polymethyl methacrylate or a polyimide is used, the ratio thereof must be set high. In general, the preferred ratio is in a range of from 5% to 50%, however, the optimal value should be set properly depending on the combination of the resins. This process can be readily practiced by those in the art. Again, in case the surface density is set high, the resulting polishing pad tends to yield weaker mechanical properties and becomes brittle, and it tends to yield inferior polishing properties as to easily cause, for instance, dishing and erosion.

By mixing a hydrophilic organic material substantially insoluble to water, the wettability of the polishing pad surface can be improved, and although the detail of the mechanism is still unknown, dust adhesion can be reduced. Accordingly, it is believed that the scratches can be minimized. The effect of suppressing dust adhesion can be obtained by mixing hydrophilic polymers at a mixing ratio of 1 to 70% by weight with respect to the unit mass of the polishing pad. In case the mixing ratio is small, the effect is also small, and is greater for a larger mixing ratio, but there often occurs a case of impairing the physical properties of the matrix. More specifically, the hardness of the matrix decreases as to lower the bending strength, thereby leading to cause brittle fracture. Accordingly, the mixing ratio is preferably in a range of from 10 to 60% by weight, and more preferably, from 20 to 50% by weight. The particles and/or fibrous materials made of hydrophilic polymer is substantially insoluble to water, they do not affect the properties of the dispersion independent of whether or not the dispersion contains free polishing abrasives. Hence, favorable polishing can be conducted. Thus, in contrast to the conventional polishing pads in which an increase in hardness and an improvement in dust adhesion or scratches were a tradeoff, the polishing pad of the invention itself can be increased in hardness without generating dust adhesion or scratches. Hence, the flexural modulus of elasticity of the polishing pad can be considerably increased as compared with the polishing pads known in the art, and extremely favorable planarization characteristics can be achieved.

The term "substantially insoluble to water" signifies that the solubility of the material for water at 25° C. is 1% or lower. The term "hydrophilic" is, basically, an expression of the property of a resin that absorbs water inside the resin, and it does not signify that the resin contains water incorporated inside the resin in macroscopic level. More specifically, in case of evaluating hydrophilic properties, a test piece immersed in water for 24 hours was taken out and placed in a sealed vessel, and water was driven out from the test piece by applying centrifugal force of 1400 G to 1450 G for 30 seconds thereto to measure the hygroscopic weight. The weight gain was obtained in accordance with equation 1 given below.

$$\text{Weight gain (\%)}=(\text{Hygroscopic weight}-\text{dry weight})/\text{dry weight}\times 100 \quad \text{(equation 1)}$$

The term "hydrophilic" as referred herein signifies a property of the material showing a weight gain of 2.0% or higher in case the material is immersed to water at 50° C. for 24 hours. In the present invention, the weight gain is preferably 5.0% or higher. In case the value is too high, swelling occurs on the polishing pad during polishing as to impair the surface planarity of the polishing pad, and this is not preferred because large fluctuation generates on the polishing rate. Furthermore, a high volume-swelling ratio is not preferred, because the strength of the polishing pad itself greatly degrades during polishing. Accordingly, it is preferred that the weight gain is 15% or lower, and in general, 10% or lower is preferred.

More quantitatively, hydrophilic properties are expressed by nominal water content. This represents the water content at a humidity of 65% and a temperature of 20° C., as shown by the following equation.

$$\text{Nominal water content (\%)}=(\text{Hygroscopic weight}-\text{dry weight})/\text{dry weight}\times 100 \quad \text{(equation 2)}$$

Then, water absorptivity refers to the water content measured 10 minutes after immersing the article in water at 25° C., expressed as follows:

$$\text{Water absorptivity (\%)}=(\text{Hygroscopic weight}-\text{dry weight})/\text{dry weight}\times 100 \quad \text{(equation 3)}$$

It is preferred that the speed of absorbing water is high, and it is preferred that a saturated state is achieved within 10 minutes. However, a resin that shows the change of 90% in 24 hours can be suitably applied. Still, in case particles and/or fibrous materials are used as the hydrophilic material substantially insoluble to water, deformation of the pad itself occurs in case water absorptivity exceeds 5000%, or stress of th polishing plane becomes too large as to make the polishing pad unfeasible. Hence, the water absorptivity is preferably within 3000%, and more preferably, within 2000%. In case of sheet-like materials, fibrous materials having an aspect ratio of 5 or higher and/or granules formed from the composites thereof, the pad itself undergoes deformation in case water absorptivity exceeds 1000%, or the stress of the polishing plane becomes too large as to make the pad unfeasible. Hence, in such a case, the water absorptivity is preferably within 6000%, and more preferably, within 3000%.

In case of mixing particles and/or fibrous materials as the hydrophilic polymer substantially insoluble to water, there may be used those having nominal water content of about 1%, but preferably used are those having nominal water content of 3% or higher. To further suppress dust adhesion, preferred to use are those having nominal water content of 5% or higher, and those of 7% or higher are more preferred because they can reduce the mixing ratio of the particles and/or fibrous materials. The term "particles" refer to those basically spherical in shape, but those deformed or having irregularities may also be used. Such having irregular and complex shape as the so-called fumed silica can be favorably used. Fibrous materials in this case refer to those having an elongated shape, with a ratio of the major axis to the minor axis exceeding 3.

The diameter of the particles (which refers to the maximum diameter in case the shape is not a sphere) is preferably 500 $\mu$m or less, and more preferably, 100 $\mu$m or less. Too large a diameter is not preferred, because the particles tend to cause frequent drop out from the matrix as to increase dust generation, thereby leading to impaired durability as a polishing pad. Accordingly, those having a diameter in a range of from 1 to 50 $\mu$m are most preferably used. The fibrous materials may be hollow fibers. The cross section shape may be of any shape proposed for new synthetic fibers, such as circular, ellipsoidal, star-like, and the like.

The ratio of the particles and/or fibrous material made of substantially insoluble to water accounting in the surface of the polishing pad, i.e., the surface density, differs depending on the matrix used. In case a polyamide resin or polyurethane resin having high water absorptivity is used, the usage thereof can be set small, but in case a polyacrylic resin such as polymethyl methacrylate or a polyimide is used, the ratio thereof must be set high. The surface density can be obtained by observing under optical microscope and by then performing image processing. In general, the preferred ratio is in a range of from 5% to 80%, however, the optimal value should be set properly depending on the combination of the resins. This process can be readily practiced by those in the art. Again, in case the surface density is set high, the resulting polishing pad tends to yield weaker mechanical properties and becomes brittle, and it tends to yield inferior polishing properties as to easily cause, for instance, dishing and erosion.

The mixing ratio of the particles and/or fibrous material depends on the nominal water content and water absorptivity referred above, but basically, the mixing ratio can be set lower in case nominal water content the water absorptivity is high, and it should be set higher in case the water absorptivity is low. In case the mixing ratio is less than 4%, the effect is insufficiently exhibited, but with a mixing ratio of 4% or higher, the dust adhesion and scratch flaws can be decreased. A lower mixing ratio results in a lower effect, and although a higher ratio results in a higher effect, the physical properties of the pad are frequently impaired. More specifically, the hardness of the pad decreases as to lower the bending strength, thereby leading to cause brittle fracture. Accordingly, the mixing ratio is preferably in a range of from 7 to 60% by weight, and more preferably, from 20 to 50% by weight.

In case of mixing sheet-like hydrophilic materials substantially insoluble to water, those having nominal water content of from about 1% can be used, but preferably used are those having a water content of 3% or higher. To further suppress dust adhesion, those having a water content of 5% or higher are preferred, and those of 7% or higher are more preferred because they can reduce the mixing ratio of the particles and/or fibrous material.

The mixing ratio of the sheet-like hydrophilic materials substantially insoluble to water depends on the nominal water content and water absorptivity referred above, but basically, the mixing ratio can be set lower in case nominal water content the water absorptivity is high, and it should be set higher in case the water absorptivity is low. In case the mixing ratio is less than 3%, the effect is insufficiently exhibited, but with a mixing ratio of 3% or higher, the dust adhesion and scratches can be decreased. A lower mixing ratio results in a lower effect, and although a higher ratio results in a higher effect, the physical properties of the pad are frequently impaired. More specifically, the hardness of the pad decreases as to lower the bending strength, thereby leading to cause brittle fracture. Accordingly, the mixing ratio is preferably in a range of from 5 to 60% by weight, and more preferably, from 20 to 50% by weight. In case of a sheet-like material, in particular, it can be mixed up to about 85% by weight because fracture less occurs on a sheet-like material.

A sheet-like hydrophilic material substantially insoluble to water comprises at least one of non-woven-like, textile-like, woven-like, felt-like, porous membrane-like, sponge-like, and film-like sheet. A non-woven-like sheet refers to a cloth in wider definition in which the fibers are confounded, but it may be stressed or may contain irregularities. Non-woven-like, woven-like, textile-like, and felt-like sheets are obtained from fibrous materials. Fibrous materials in this case refer to those having an elongated shape, with a ratio of the major axis to the minor axis exceeding 10. In wider definition, porous membrane-like and sponge-like sheets signify films containing two-dimensional and/or three-dimensional open pores with high porosity, and film-like sheets refer to those substantially free from open pores.

The diameter (which refers to the maximum diameter in case the shape is not a sphere) of the fibers constituting the above materials is preferably 100 $\mu$m or less, more preferably, 50 $\mu$m or less, and suitably used are those having a diameter in a range of from about 2 to about 20 $\mu$m. In case of ultrafine fibers, known are those having a diameter of less than 2 $\mu$m, and it is convenient to use such. Those too large in diameter are not preferred, because they tend to cause frequent drop out from the matrix and reduce the durability of the polishing pad. The fibrous materials may be hollow fibers. The cross section shape may be of any shape proposed for new synthetic fibers, such as circular, ellipsoidal, star-like, and the like. The porous membrane-like and sponge-like sheets contain pores connected with fine columns, and the diameter of the columns range from about 10 nm to about 1 mm; however, there is no particular limits concerning their size. By using sheets having interstices accounting in volume, i.e., porosity, of a high ratio exceeding 25%, and by shaping them by compressing in the thickness direction, the fluctuation in the thickness direction can be favorably suppressed. The film-like sheets are suitably used for forming the layers (separation layer) that separate the layers constituting the laminate from each other. In particular, ultra thin films having a thickness of less than 1 $\mu$m can be used in a manner similar to the non-woven-like, woven-like, textile-like, felt-like, porous membrane-like, and sponge-like sheets.

The mixing ratio of the particles formed from fibrous hydrophilic materials with an aspect ratio of 5 or higher and substantially insoluble to water and/or the composite thereof depends nominal water content and water absorptivity referred above, but basically, the mixing ratio can be set lower in case the nominal water content and the water absorptivity is high, and it should be set higher in case the water absorptivity is low. In case the mixing ratio is less than 4%, the effect is insufficiently exhibited, but with a mixing ratio of 4% or higher, the dust adhesion and scratches can be decreased. A lower mixing ratio results in a lower effect, and although a higher ratio results in a higher effect, the physical properties of the pad are frequently impaired. More specifically, the hardness of the pad decreases as to lower the bending strength, thereby leading to cause brittle fracture. Accordingly, the mixing ratio is preferably in a range of from 7 to 60% by weight, and more preferably, from 20 to 50% by weight. The aspect ratio is expressed by (the length of the major axis of the particle)/(the length of the minor axis of the particle), and in the present invention, those having an aspect ratio of 5 or higher is referred to as fibrous materials. A fibrous composite refers to a composite formed by aggregating those fibrous materials in their fibrillation state. For instance, it refers to a shape of an ultrafine fiber precursor having a core and sheath structure. In the present invention, particles refer to the fibrous materials aggregated into a particle-like shape. The aspect ratio is defined for the ultrafine fibers constituting the particle-like material. By mixing the materials above with such a shape as fillers, the polishing pad itself allows stress relaxation during polishing as to suppress the generation of dust adhesion and scratches.

In case of a polishing pad comprising an organic polymer matrix obtained by laminating the sheet-like materials, in particular, plural sheet-like materials are laminated to form a single polishing pad. Accordingly, the polishing pad of the present invention yields an extremely high strength against bending, and rarely causes fracture. As a matter of course, the polishing pad may be constructed by using a single thick sheet-like material. However, a polishing pad having high stability in polishing properties and yet capable of precisely controlling the state of the polishing plane can be readily formed by forming layers having a thickness of about 1 $\mu$m and/or thicker per layer, and by then superposing a plurality of such layers. In general, those having a thickness of 5 $\mu$m or more are used, and preferably, those with a thickness of 100 to 300 $\mu$m are used. The thickness or the material of the layers need not be the same, and the resin content and/or type of the matrix resin as well as the thickness and/or type of the sheet-like materials may be differed every layer to realize precisely designed polishing pad.

For instance, a cushion layer comprising foamed polyurethane, rubber sheet, and the like, may be combined with a polishing layer portion, cushion layer portion, and the separating layer portion to make one set, and a plurality of such sets may be laminated. By once adhering such a pad to a polishing disk, a long-life polishing pad, which allows use of the pads without exchanging for a long term never realized before can be provided. The incorporation of a separating layer allows polishing to be performed with a virgin plane formed by dressing without allowing the polishing layer to be brought into contact with the polishing liquid or with the polishing dispersion intruded from the polishing plane. Hence, an extremely high polishing stability can be realized. Furthermore, in case it is necessary to provide layers for polishing alternately an interlayer insulator film and a metal, it is possible to shape the pad with optimal arrangement; for instance, an extremely hard layer may be provided for polishing the interlayer insulator film, and a soft layer may be provided for metal polishing. Those in the art may easily determine such a combination. In this manner, the present invention allows improvement in production through put, and is effective for total cost down.

As the method for forming the laminated polishing pad, there can be used a method comprising forming in advance a compound of a sheet-like hydrophilic material substantially insoluble to water with an organic polymer matrix, optionally, together with inorganic fine particles and/or water soluble material, and after impregnating, shaping the resulting compound by thermal compression. In such a case, the viscosity of the compound may be adjusted by using a solvent, and thermal compression for shaping may be applied after drying. Since a sheet-like material is used, the matrix resin alone may be impregnated under pressure, and a layer formed by uniformly dispersing inorganic particles and/or by uniformly scattering water-soluble substance in a similar manner may be laminated thereafter to subject the resulting laminated structure to thermal compression shaping. By increasing the number of layers, the fluctuation in physical properties of the resulting polishing pad can be reduced.

It is also possible to polymerize the monomer molecules of the matrix of a sheet-like hydrophilic material substantially insoluble to water with them, optionally, after impregnating them with inorganic fine particles and/or water-soluble materials. In case the matrix is of a two-part type such as polyurethane, the sheet-like material may be impregnated under pressure after mixing the base agent or the hardening agent, and then shaped. Cutting process may be applied thereafter to finish into the shape of the polishing pad. The details depend on the miscibility of each of the matrices with the hydrophilic polymer substantially insoluble to water, as well as on the individual physical properties such as the heat resistance, polymerization characteristics, melt viscosity, and the like.

As the method for shaping a mixture of particles, and/or fibrous materials, and/or fibrous materials having an aspect ratio of 5 or higher, and/or particles formed from the composites thereof into a polishing pad, there can be mentioned a method comprising forming in beforehand a compound of the matrix with the hydrophilic polymer substantially insoluble to water, and then shaping the resulting compound by thermal compression. Otherwise, there may be used melt extrusion molding. Also available is a method such as using an injection press.

It is also possible to polymerize the monomer molecules of the matrix after impregnating a hydrophilic polymer substantially insoluble to water with them. In case the matrix is of a two-part type such as polyurethane, the base agent or the hardening agent is mixed with a hydrophilic polymer substantially insoluble to water in beforehand, and after further mixing therein the hardening agent or the base agent, respectively, the resulting mixture is fed inside a proper mold after degassing operation. It is also possible to apply cutting process thereafter to finish the resulting product into the shape of the polishing pad. The details depend on the miscibility of each of the matrices with the hydrophilic polymer substantially insoluble to water, as well as on the individual physical properties such as the heat resistance, polymerization characteristics, melt viscosity, and the like. However, the combination can be readily selected by those in the art. Thus, concerning the method of production, the polishing pad according to the present invention can be obtained by combining known techniques.

The polishing pad of the invention preferably comprises grooves or holes provided on its surface with an aim to accelerate supplying or discharging polishing liquid to or from the polishing plane. The grooves may be provided in various configurations, such as concentric circles, spirals, radiating lines, checker board arrangement, and the like. The grooves may have cross section shapes in the form of a rectangle, triangle, semicircle, and the like. The grooves are provided at a depth of from 0.1 mm to the thickness of the polishing layer, at a width ranging from 0.1 to 5 mm, and at a pitch ranging from 2 to 100 mm. The holes may or may not penetrate the polishing layer. The diameter of the holes may be selected in a range of from 0.2 to 5 mm. The pitch of the holes may range from 2 to 100 mm.

As the resin or the organic polymer matrix constituting the polishing pad, usable are the thermoplastic resins such as those based on polyamide, polyacrylic, polyolefins, polyvinyl, ionomers, polycarbonate, polyacetal, polyurethane, polyimide, and the like. Also usable are the derivatives, copolymers, and graft products of those enumerated above. A mixture of those is also usable, but the blending ratio must be set as such to result in a desired hardness.

For instance, the hardness may be improved effectively by mixing inorganic fine particles. The technology disclosed in relation to nanocomposites may be applied and extended. More specifically, usable as inorganic fine particles are the crystals of, for instance, silica, ceria, alumina, zirconia, titanium, tungsten, barium carbonate, barium sulfate, carbon black, clay minerals such as montmorillonite, zeolite, and the like. Mixtures thereof are also usable. It is also possible to subject the surface to modification treatment to improve their affinity with the matrix.

The usable particle diameter is in a range of from about 3 nm to about 50 $\mu$m, but too large a particle size increases the danger of causing scratches. Accordingly, preferably, the particle diameter is 20 $\mu$m or smaller, and more preferably, 5 $\mu$m or smaller. Concerning the weight ratio of mixing the fine particles of silica, ceria, alumina, zirconia, titanium, tungsten, barium carbonate, barium sulfate, carbon black, clay minerals such as montmorillonite, zeolite, and the like, an effect can be obtained at an addition of from about 1% to about 80%. In case the fine particles are added to a high concentration, they are effective not only for increasing the hardness of the polishing pad, but also for a polishing pad inclusive of abrasives, i.e., as a so-called polishing pad with fixed abrasives. In such a case, the effect is smaller with smaller particle diameter; hence, particles with diameter of 30 nm or greater are preferred, and from the viewpoint of increasing the polishing rate, more preferred are particles 100 nm or greater in diameter. By changing the particle diameter and the mixing ratio of such fine particles, there can be obtained polishing pads corresponding to the properties of the article to be polished.

As other usable organic polymer matrices, there can be mentioned thermosetting resins such as those based on polyurethane, epoxy, phenolic, melamine, urea, polyimide, and the like. Mixed resins (inclusive of alloys), as well as the modification techniques such as copolymerization, grafting, modification, and the like, may be employed. In the present invention, the resin constituting the polishing pad is properly selected based on the desired hardness, elasticity, and wear resistance. In this case again, inorganic fine particles may be mixed in a manner similar to the case of using a thermoplastic resin as described above. In this case, however, the particles should be dispersed in the state of a prepreg.

Since a thermoplastic resin is softer than a common thermosetting resin, particles and/or fibrous materials made of a hydrophilic organic material substantially insoluble to water that are mixed with the thermoplastic resin may be lower in nominal water content. Those having a nominal water content as low as about 1% may be used, but to further decrease the dust adhesion and scratches, those having a water content of 3% or higher are preferred. Similarly, the thermosetting resins used are preferably high in nominal water content. In such a case, in particular, the water content is preferably 5% or higher, and more preferably, 7% or higher.

The polishing pad according to the present invention after shaping preferably yields D hardness value exceeding 65. In case D hardness is 65 or lower, the polishing pad becomes too soft as to cause dishing and erosion, and this is not preferred. Furthermore, to increase the polishing rate, the polishing pad preferably yields a D value of 70 or higher, and more preferably, 80 or higher. In the present invention, those with a further increased D hardness exceeding 90 are also usable without causing any problems concerning scratches and dust adhesion. Accordingly, favorable polished planarization characteristics never achieved to present can be exhibited by the present invention.

As explained above, the flexural modulus of elasticity of the polishing pad can be increased as compared with a conventional polishing pad. To achieve favorable planarization characteristics, the flexural modulus of elasticity is preferably 0.5 GPa or higher, and more preferably, 2 GPa or higher. Since there is no problems of dust adhesion and scratches, further higher flexural modulus of elasticity of 5 GPa or higher but not higher than 20 GPa is preferred for the polishing pad according to the present invention. However, since too high a flexural modulus of elasticity makes the attachment of the polishing pad difficult, the preferred range is 100 GPa or lower.

With respect to the hydrophilic polymers substantially insoluble to water, for instance, there can be used resins based on cellulose, acrylic acid, polyamide, starch, and the like, as well as the crosslinked products and polymers containing those resins as the principal component. Commercially available polyvinyl pyrrolidone, polyvinyl pyrrolidone/vinyl imidazole copolymers, high water absorption resins, pulp, paper, cellulose esters, aramid resins such as "Kevlar", cellulose imparted with various types of charges for use as ion exchange resins, and the like may well be used. The surface of such resins may be subjected to modification treatment to improve the affinity with the matrix. Basically, those having a solubility parameter $\delta_{sp}$ of 11.5 or higher and $\delta_h$ of 4 or higher are favorably used. For the solubility parameter, reference can be made to, for instance, Takeshi Matsuura, "Gosei-maku no Kiso (Fundamentals of Synthetic Films)" (published by Kitami Shobo, Oct. 20, 1985), pages 32 and 33.

For the polymers substantially insoluble to water used in the polishing pad according to the present invention, there may also be used resins based on starch, polysaccharides such as chitin, protein, polyamide, polyvinyl alcohol, ethylene-vinyl alcohol copolymer, and the like, as well as the crosslinked products and copolymers containing those resins as the principal component thereof. Commercially available natural fibers such as silk, wool, cotton, linen, and the like may be effectively utilized. Furthermore, resins that are inherently hydrophobic but into which groups such as sulfonic group, amino group, carboxyl group, hydroxyl group, and the like are introduced may well be used. Hydrophobic resins in this case refer to those having a weight gain with reference to equation 2 above of less than 2%. Further preferred is to use those in which sodium ion content is suppressed to 400 ppm or lower. The sodium ion content is suppressed to, more preferably, 50 ppm or lower, and further preferably, 10 ppm or lower.

The polishing pad according to the present invention may further contain water-soluble materials. Commercially available polymers include various types of polyalkylene glycols, polyvinyl alcohol, polyvinyl acetate, chitosan, polyvinylpyrrolidone, polyvinyl imidazole, water-soluble polysaccharaides, and the like, and these may be used. In addition to those, various types of low molecular substances such as various types of inorganic salts may be mixed. By mixing the matrix with the water-soluble polymers in this manner, the water-soluble polymer portion dissolves and drops out from the matrix during polishing as to form micro-sized hetero fine pores. In this case again, a compound formed in advance may be shaped by thermal compression, or subjected to melt extrusion molding. Also available is a method such as using an injection press, and combinations of known techniques may be employed. It is also possible to use hydrophilic polymers substantially in soluble to water together with water-soluble polymers. Since particles and/or fibrous materials made of hydrophilic organic materials substantially insoluble to water, i.e., hydrophilic organic materials, are used in the present invention, these are dried on shaping a polishing pad according to the present invention. However, vapor generates on heating for shaping because complete removal of water is difficult. Accordingly, interstices can be formed at portions other than particles and/or fibrous materials. In case thermosetting resins are used, water generates in some cases such as those in which phenolic resin is employed. Thus, by using such resins, interstices can be formed at portions other than particles and/or fibrous materials. To control the size of the interstices, for instance, water vapor may be properly drawn out during setting. However, when necessary, water-soluble materials may be mixed in small quantities to enable precise control of the interstices. Furthermore, since the water-soluble materials elute out during polishing, interstices can be formed only on the surface of the polishing pad. Such interstices improve the retention of the free abrasives contained in the polishing slurry, or are effective for the removal of polish wastes, and in some cases, they are advantageous in increasing the polishing rate. Moreover, in case the water-soluble materials dissolve in the dispersion of the polishing liquid, the viscosity of the dispersion can be changed. Accordingly, in case xanthane rubber, i.e., a water-soluble polysaccharide, for instance, is mixed and dissolved in the polishing liquid, the solution tends to exhibit Bingham fluid-like characteristics; hence, probably, on the semiconductor wafer having surface irregularities, the diffusion of abrasive grains at the concave portions is suppressed. In this manner, it works effective for improving the planarity, particularly, the global planarity on polishing the wafer. Although it is possible to exhibit the effect of the water-soluble materials with an addition of about 0.01 wt % with respect to the unit weight of the polishing pad, the water-soluble materials are preferably added at an amount of 0.5 wt % or higher but not higher than 5 wt % to effectively achieve these effects. In case the water-soluble materials are added at an amount exceeding 10 wt %, the characteristics of the polishing dispersion change unfavorably excessively. Although it is possible to increase the addition amount by using a lower molecular weight substance which less influences the viscosity of the dispersion, this is not practical from the viewpoint of increasing cost.

The polishing pad according to the present invention may contain nanocomposites above such as inorganic particles, and easily accomplishes improved polishing properties by enabling harder polishing pads as compared with a conventionally known polishing pads made from resins. More specifically, the generation of dishing and erosion can be reduced. In particular, favorable results concerning scratches can be obtained by combining them with abrasive grains having smaller particle diameter.

Furthermore, the polishing pad according to the present invention is characterized in one aspect that the nanocomposite used therein is a nanocomposite with silica particles, and that the polishing pad is usable as a fixed abrasive pad in which polishing liquid free from abrasives is supplied. The term "nanocomposite" as expressed in the present invention refers to materials ranging from a mixture of particles in the order of nanometer size to a mixture comprising fine particles about several tens of micrometers in size. In case the particles are too large, the effect of increasing hardness becomes small. Hence, the diameter of the particles is preferably 20 $\mu$m or smaller, and in order to reduce the danger of generating scratches during polishing, preferably used are particles 1 $\mu$m or smaller in diameter. On the contrary, in case particles too small in diameter are used, they no longer exhibit the effect as fixed abrasives. Hence, preferred are particles 10 nm or larger in diameter. As the organic-inorganic nanocomposites, preferably used is at least one selected from a combination of a phenolic resin and silica particles, a combination of an epoxy resin and silica particles, and a combination of a polyamide resin and silica particles. However, any nanocomposite newly developed may be used in addition to those enumerated above. For instance, ceria based fine particles are a candidate.

Concerning the quantity of mixing silica fine particles as the nanocomposite in % by weight, the effect can be achieved even with an amount of about 1%, and the amount may be increased up to about 80%. The silica particles maybe mixed in an amount of, in % by weight, 2 to 70% in case of polyamide resin, 2 to 85% in case of epoxy based resin, and 2 to 50% in case of phenolic resin. The addition of the nanocomposite can be set properly depending on the desired hardness. Furthermore, those commercially available may be used.

In addition to above, semiconductor wafers can be polished by using fine particles of barium carbonate. Fine particles of barium carbonate may be used in combination with a hydrophilic polymer, or may be used alone.

More specifically, usable as inorganic fine particles are the crystals of, for instance, silica, ceria, alumina, zirconia, titanium, tungsten, barium carbonate, barium sulfate, carbon black, clay minerals such as montmorillonite, zeolite, and the like. Mixtures thereof are also usable. It is also possible to subject the surface to modification treatment to improve their affinity with the matrix.

The usable particle diameter is in a range of from about 3 nm to about 50 $\mu$m, but too large a particle size increases the danger of causing scratches. Accordingly, preferably, the particle diameter is 20 $\mu$m or smaller, and more preferably, 5 $\mu$m or smaller. Concerning the weight ratio of mixing the fine particles of silica, ceria, alumina, zirconia, titanium, tungsten, barium carbonate, barium sulfate, carbon black, clay minerals such as montmorillonite, zeolite, and the like, an effect can be obtained at an addition of from about 1% to about 80%. In case the fine particles are added to a high concentration, they are effective not only for increasing the hardness of the polishing pad, but also for a polishing pad inclusive of abrasives, i.e., as a so-called polishing pad with fixed abrasives. In such a case, the effect is smaller with smaller particle diameter; hence, particles with diameter of 30 nm or greater are preferred, and from the viewpoint of increasing the polishing rate, more preferred are particles 100 nm or greater in diameter. By changing the particle diameter and the mixing ratio of such fine particles, there can be obtained polishing pads corresponding to the properties of the article to be polished.

The polishing pad according to the present invention is characterized in that, on taking the centerline average roughness Ra of a single silicon wafer having provided with an oxide film after polishing, the difference in value of Ra falls in a range of 0.2 $\mu$m or less with respect to the surface roughness profile generated by dressing before polishing taken as the standard. For instance, it is characterized in that it comprises at least two types of domains formed by blending at least two types or more of polymers differing in abrasive wear rate on polishing. Many types of polymers undergo microscopic phase separation, and various types of combinations are known. Hence, such knowledge can be utilized. However, care should be taken since the domain size tends to be too small. The resins to be used are preferably combined in such a manner that they may exhibit poor miscibility with each other, or that one become a liquid while the other does not on shaping.

The size of the two types or more of domains is ideally the same for both, and the ratio of the average total domain area (i.e., the total area of the smallest domain/the total area of the largest domain) is preferably in a range of from 0.1 to 3.5. Furthermore, a ratio in a range of from 0.3 to 2.5 is more preferred because the difference in polishing rate is small. However, in case three types or more domains are formed, and in case two of them are in an included relation, they are regarded as two types of domains present. The size of the domains can be measured with an optical microscope. Commercially available are apparatuses comprising a combination of an optical microscope and CCD camera. By utilizing such apparatuses, data processing can be easily performed on a personal computer and the like. Preferably, at least one of the formed domains has a size ranging from $10^{-12}$ $m^2$ to $10^{-6}$ $m^2$. The size of a single domain is larger the better. However, in case it is too large for a polishing pad, the mechanical strength of the pad surface tends to be too low, and may lead to an extremely impaired durability when used in polishing. In such a case, the problem of making it unable to obtain a sufficiently high polishing rate may arise. The threshold value for the size differs depending on the resin mainly constituting the pad, however, it has been found that this disadvantage can be circumvented by setting the diameter to 1 mm or smaller. The polishing characteristics are not particularly affected by whether the domain size is large or small; however, it leads to difficulties concerning shapability of the polishing pad and the suppression of the fluctuation in quality. It is one solution to establish a so-called micro phase separation structure, but it is difficult to maintain the same state for the surface and the inside of the polishing pad, and hence, it is extremely difficult to control the micro phase separation structure over the entire film thickness. Accordingly, there may be employed a simple method as such using two types or more of polymers belonging in an immiscible system, modifying the surface of one polymer in such a manner to achieve good affinity with the other polymers, and then dispersing the polymer in microscopic level. As a matter of course, the present invention may be utilized more conveniently by employing a combination of polymers in which there is no need of improving the affinity.

The polishing pad designed in the manner above realizes a polishing pad capable of maintaining favorable polishing characteristics, for instance, even in case of polishing a semiconductor wafer, there is no need of performing dressing using a diamond dresser, and yet, favorable polishing characteristics can be continuously obtained by carrying out simple operation of brushing and the like without applying any load. Although the mechanism is yet to be clarified, the use of different types of polymers in mixture probably provides domains that individually undergo abrasive wear at different rates, thereby resulting in a uniformly maintained surface roughness.

On studying the polishing rate in practice, no fluctuation in polishing rate was found even in case five semiconductor wafers were continuously polished. Furthermore, the surface roughness was measured at the same time to find little change in the value of the centerline average roughness Ra. In this case, it should be stressed that the value of the centerline average roughness, Ra, generally fell in a range of from 3 to 5 $\mu$m, and the change on polishing was 0.2 $\mu$m/wafer or lower. Furthermore, a change in Ra of 0.15 $\mu$m/wafer or lower is preferred from the viewpoint of increasing stability in polishing rate. In case further precision is required, the change in Ra of 0.1 $\mu$m/wafer or lower is preferred. By thus incorporating a mechanism for suppressing the change in the value of the centerline average roughness Ra small as in the present invention, it has been found that the polishing characteristics can be maintained, and that the objects can be achieved.

Furthermore, the change in value of the surface centerline average roughness Ra was found to be further minimized by mixing a water-soluble polymer in the matrix, since the water-soluble polymer portion dissolves and falls out from the matrix during polishing. It is possible to use a hydrophilic polymer insoluble to water together with a water-soluble polymer.

By employing the constitution above, a polishing pad having favorable global planarization characteristics and yet superior in polishing stability can be provided while suppressing the generation of problems of dust adhesion and scratches. There may slightly remain problems of dust adhesion and scratches depending on the combination and/or the mixing weight ratio of the matrix resin and the hydrophilic polymer substantially insoluble to water. In such a case, optimization can be carried out by measuring the water absorptivity or the water absorption rate of the finished resin sheet, and by then performing adjustments as follows. Concerning absorptivity, a value of 0.8% or higher for one-hour absorptivity is preferred, and to suppress dust adhesion, a value of 1% or higher is preferred, more preferably, 2% or higher. Too high an absorptivity is not preferred because the stability in polishing rate becomes impaired. Hence, the absorptivity is preferably 15% or lower. Concerning absorption rate, it is preferred that the water absorption rate within 5 minutes from contact with water is 3%/hr or higher, and to further suppress the problems of dust adhesion and scratches from occurring, the rate is preferably 6%/hr or higher, and more effectively, it is preferably 9%/hr or higher.

Preferably, the polishing pad comprises grooves or holes provided on its surface with an aim to accelerate supplying or discharging polishing liquid to or from the polishing plane. The grooves may be provided in various configurations, such as concentric circles, spirals, radiating lines, checker board arrangement, and the like. The grooves may have cross section shapes in the form of a rectangle, triangle, semicircle, and the like. The grooves are provided at a depth of from 0.1 mm to the thickness of the polishing layer, at a width ranging from 0.1 to 5 mm, and at a pitch ranging from 2 to 100 mm. The holes may or may not penetrate the polishing layer. The diameter of the holes may be selected in a range of from 0.2 to 5 mm. The pitch of the holes may range from 2 to 100 mm. Any configurations and shapes may be selected so long as they satisfy the requirements of suitably supplying the polishing liquid to the polishing plane, of increasing retention of the polishing liquid, of favorably discharging and/or accelerating the discharging of the polishing liquid together with the polishing waste. The polishing pad may be processed into various shapes, such as those of disks, donuts, belts, and the like. The thickness of the polishing pad may vary from about 0.1 mm to about 50 mm, or may be provided thicker than those. Concerning the diameter when shaped into disks or donuts, the diameter may range from ⅕ to 5 times as large as that of the size of the article to be polished; however, those too large in size are not preferred because the processing efficiency becomes impaired.

The polishing pad obtained in accordance with the present invention may be used as a composite polishing pad by laminating it with a cushion sheet having a cushioning function. A semiconductor substrate comprises a larger waviness in addition to local irregularities, and in many cases, a cushion sheet is frequently provided under the hard polishing pad (on the polishing disk side) as a layer absorbing such waviness. As the cushion sheet, a foamed urethane based material and a rubber-based material may be used in combination.

There is no particular limitations on the material to be employed for the cushion sheet, and, in addition to the commonly used polyurethane impregnated non-woven cloth (for instance, Suba400 (trademark) manufactured by Rodel Inc.), there may be employed rubber, foamed elastomer, foamed plastics, and the like. However, preferred is a cushion layer having a volume elastic modulus of 60 MPa or higher and having a tensile modulus of elasticity in a range of from 0.1 to 20 MPa. In case the tensile modulus of elasticity is small, there is a tendency of impairing the uniformity in planarity of the entire surface of the semiconductor substrate. Those having a high tensile modulus of elasticity also tend to impair the uniformity in planarity of the entire surface of the semiconductor substrate. Further preferable range for the tensile modulus of elasticity is from 0.5 to 10 MPa.

The volume elastic modulus as referred herein can be obtained by applying an isotropic pressure to an article having its volume measured in advance, and by measuring the change in volume. The volume elastic modulus is defined as follows: Volume elastic modulus=applied pressure/(change in volume/original volume). For instance, in case a change in volume of 0.00005 $cm^3$ is obtained when a pressure of 0.07 MPa is applied to an article having an original volume of 1 $cm^3$, the volume elastic modulus is 1400 MPa. As a method for measuring the volume elastic modulus, there can be mentioned, for example, a method comprising measuring the volume of the article in advance, immersing the article in water contained in a vessel, placing the vessel in a pressure vessel and applying pressure thereto, and obtaining the change in volume and the applied pressure from the change in height of water inside the vessel. Concerning the liquid into which the article is immersed, there are no particular limitations so long as a liquid is used, but preferably avoided is to use a liquid which swells or destroys the article; for instance, usable are water, mercury, silicone oil, and the like. The tensile modulus of elasticity can be obtained by shaping the cushion layer into a dumbbell-like shape, applying tension thereto, and measuring the tensile stress while the tensile strain (=change in tensile length/original length) is in a range of from 0.01 to 0.03. Thus, the tensile modulus of elasticity can be defined as follows:

Tensile modulus of elasticity=((Tensile stress at a tensile strain of 0.03)−(tensile stress at a tensile strain of 0.01))/0.02.

As a component constituting the cushion layer having the characteristics above, mentioned as non-limiting materials are rubbers, more specifically, non-foamed elastomers such as natural rubber, nitrile rubber, neoprene rubber, polybutadiene rubber, polyurethane rubber, silicone rubber, and the like. The cushion layer is preferably provided at a thickness in a range of from 0.1 to 100 mm. In case the thickness is too small, there is a tendency of impairing the uniformity in planarity of the entire surface of the semiconductor substrate. On the contrary, in case the thickness is too large, there is a tendency of impairing the local planarity. A further preferred range in thickness is from 0.2 to 5 mm. A still preferred range in thickness is from 0.5 to 2 mm.

The polishing pad according to the present invention is used by fixing it to a polishing disk. In such a case, care should be taken that the cushion layer is fixed in such a manner that it may not be displaced during polishing, and that the polishing layer may not be displaced from the cushion layer. As a method for fixing the cushion layer to the polishing disk, there can be mentioned, without any limitations, a method comprising fixing the cushion layer with a double-sided adhesive tape, a method comprising fixing with an adhesive, a method comprising fixing the cushion layer by sucking it from the polishing disk, and the like. As a method for fixing the polishing layer to the cushion layer, there can be mentioned, without any limitations, a method comprising fixing the cushion layer with a double-sided adhesive tape or a method comprising fixing with an adhesive.

As the double-sided adhesive tape or an adhesive layer preferred for adhering the polishing layer to the cushion layer, there can be specifically mentioned a double-sided adhesive tape 463, 465, 9204, and the like manufactured by Sumitomo 3M Co., Ltd., a double-sided adhesive tape No. 591 and the like manufactured by Nitto Denko Co., Ltd., which is a substrate-free acrylic adhesive transfer tape, Y-4913 and the like manufactured by Sumitomo 3M Co., Ltd., which is a double-sided adhesive tape using foamed sheet as the base, and 447DL and the like manufactured by Sumitomo 3M Co., Ltd., which is a double-sided adhesive tape using soft vinyl chloride as the base.

In case there is necessity of exchanging the polishing layer after polishing due to reasons such as inability of achieving the desired polishing rate and the like, in the present invention, it is possible to detach the polishing layer from the cushion layer while maintaining the cushion layer fixed to the polishing platen. Since the cushion layer has a higher durability as compared with the polishing layer, it is preferred to exchange the polishing layer alone from the viewpoint of cost.

In case the polishing pad according to the present invention is used in the production of semiconductor chips, for instance, it may be employed for polishing a semiconductor wafer (bare wafer, and/or a wafer having a surface provided with an oxide film) before performing surface roughening process thereto, such that the fine irregularities inherent to the wafer, i.e., surface defects expressed as waviness or nanotopology, may be preferably removed. Then, surface-patterning process is performed by means of lithography and the like, and CMP is applied thereafter. By carrying out the process steps using the polishing apparatus according to the present invention, processing at high planarity can be realized, and this easily satisfies the requirements of multilayering, high integration, and fine interconnection of semiconductor chips. Furthermore, preferably used as the polishing pad according to the present invention are those whose sodium ion concentration is suppressed to 400 ppm or lower; more preferably, sodium concentration thereof is suppressed to 50 ppm or lower, and most preferably, 10 ppm or lower.

The polishing pad according to the present invention is utilized for polishing the surface of insulating layers or metallic layers formed on a semiconductor wafer. As the insulating layers, there can be mentioned interlayer dielectric films for metallic interconnections, a lower dielectric film for metallic interconnections, and shallow trench isolation for use in isolating elements. As metallic interconnections, examples include those of aluminum, tungsten, copper, and the like, which may be used in structures such as damascene, dual damascene, plug, and the like. In case copper is used for the metallic interconnection, barrier metals such as silicon nitride are also the objects to be polished. Silicon oxide is mainly used for the dielectric film, however, by taking the problems concerning delay time into consideration, low dielectric insulating films would also be brought into use. Although low dielectric insulating film is softer and more brittle than silicon oxide, the polishing pad according to the present invention enables polishing in a state relatively free from scratches. In addition to semiconductor wafers, the polishing pad according to the present invention is also applicable to the polishing of magnetic heads, hard disks, liquid crystal displays, plasma display related members, sapphire, and the like.

The present invention is explained in further detail below by making reference to some examples.

EXAMPLE (Measurement of the Amount of Dust Adhered)

A polishing pad 1.2 mm in thickness and 38 cm in diameter was produced, and the surface thereof was subjected to a so-called X-Y groove processing (processing of lattice-like grooves) to provide grooves 2.0 mm in width, 0.5 mm in depth, and 15 mm in pitch. The pad was adhered to a disk of a polishing machine ("L/M-15E", manufactured by Lapmaster SFT Corp.), by first providing Rodel Inc., Suba400 as the cushion layer and by then using double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the fixing disk at a rotation of 25 rpm and rotating the conditioner at the same direction at a rotation of 25 rpm. The surface of the polishing pad was rinsed for 2 minutes while flowing pure water at a rate of 100 ml/min to the polishing machine, and subsequently, a wafer having provided with an oxide film (a 4-inch dummy wafer CZP type, manufactured by Shin-Etsu Chemical Co., Ltd.) was set to the polishing machine, and polishing was performed thereon under a pressing pressure of 0.04 MPa for 5 minutes, while rotating the polishing platen at a rotation of 45 rpm and rotating the conditioner at the same direction at a rotation of 45 rpm, and while supplying, at a rate of 100 ml/min, a slurry dispersion ("SC-1", manufactured by Cabot Microelectronics Corporation) having prepared at a concentration described in the instruction manual. Care was taken not to dry the surface of the wafer by immediately supplying pure water, and the wafer surface was cleaned by using a polyvinyl alcohol sponge. Then, the surface of the wafer was dried by blowing dry compressed air. The number of dust particles 0.5 $\mu$m or larger in diameters, which were present on the surface, was measured by using a wafer surface dust detection apparatus ("WM-3" manufactured by TOPCON Co., Ltd.). In case dust particles found are 400 counts or less may pass the present test, and no problems are found in producing the semiconductor.

(Measurement of the Rate for Polishing Oxide Film)

The thickness of the oxide film on the surface of the wafer (a 4-inch dummy wafer CZP type, manufactured by Shin-Etsu Chemical Co., Ltd.) was measured at 196 fixed points that were determined in advance by using "Lambda Ace" (VM-2000) manufactured by Dainippon Screen Mfg. Co., Ltd. The polishing pad to be tested was adhered to a platen of a polishing machine ("L/M-15E", manufactured by Lapmaster SFT Corp.), by first providing Rodel Inc., Suba400 as the cushion layer and by then using double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the platen at a rotation of 25 rpm and rotating the conditioner at the same direction at a rotation of 25 rpm. The surface of the polishing pad was rinsed for 2 minutes while flowing pure water at a rate of 100 ml/min to the polishing machine, and subsequently, the wafer having provided with an oxide film, whose thickness had been already measured, was set to the polishing machine, and polishing was performed thereon under a pressing pressure of 0.04 MPa for 5 minutes, while rotating the platen at a rotation of 25 rpm and rotating the conditioner at the same direction at a rotation of 25 rpm, and while supplying, at a rate of 100 ml/min, a slurry dispersion ("SC-1", manufactured by Cabot Microelectronics Corporation) having prepared at a concentration described in the instruction manual. Care was taken not to dry the surface of the wafer by immediately supplying pure water, and the wafer surface was cleaned by using a polyvinyl alcohol sponge. Then, the surface of the wafer was dried by blowing dry compressed air. The thickness of the oxide film provided on the surface of the wafer was measured at 196 fixed points that were determined in advance by using "Lambda Ace" (VM-2000) manufactured by Dainippon Screen Mfg. Co., Ltd.). Thus, the polishing rate was calculated at each of the points, and the average value thereof was obtained as the polishing rate for the oxide film.

Then, conditioning of the polishing pad was performed only on the first polishing, and stability in polishing rate was evaluated by polishing the wafer having thereon the oxide film after directly measuring the thickness of the oxide film without performing any conditioning of the polishing pad from the second time.

(Evaluation of Dishing 1)

Test wafer for evaluating tungsten interconnection dishing: Grooves each 100 $\mu$m in width and 0.7 $\mu$m in depth were formed at a space interval of 100 μm on a 4-inch silicon wafer provided with an oxide film (2 μm in oxide film thickness). Tungsten coating was formed thereon by means of sputtering at a thickness of 2 μm to obtain a test wafer for evaluating tungsten interconnection dishing.

A circular polishing layer 38 cm in diameter was prepared, and the surface thereof was subjected to a so-called X-Y groove processing (processing of lattice-like grooves) to provide grooves 2.0 mm in width, 0.5 mm in depth, and 15 mm in pitch. The resulting polishing pad was adhered to a platen of a polishing machine ("L/M-15E", manufactured by Lapmaster SFT Corp.), by first providing Rodel Inc., "Suba400" as the cushion layer and by then using a double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the platen at a rotation of 25 rpm and rotating the conditioner at the same direction at a rotation of 25 rpm. The surface of the polishing pad was rinsed for 2 minutes while flowing pure water at a rate of 100 ml/min to the polishing machine, and subsequently, the test wafer for evaluating tungsten interconnection dishing was set to the polishing machine, and polishing was performed thereon under a pressing pressure of 0.04 MPa for 2 minutes, while rotating the platen at a rotation of 45 rpm (at a linear velocity at the center of the wafer of 3000 (cm/min)) and rotating a semi-conductor wafer holding table at the same direction at a rotation of 45 rpm, and while supplying, at a rate of 100 ml/min, a 1:1 mixed slurry solution of a slurry ("SEMI-SPERSE W-A400", manufactured by Cabot Microelectronics Corporation) having prepared at a concentration described in the instruction manual and an oxidizing agent ("SEMI-SPERSE FE-400", manufactured by Cabot Microelectronics Corporation). Care was taken not to dry the surface of the wafer by immediately supplying pure water, and the wafer surface was cleaned by using a polyvinyl alcohol sponge. Then, the surface of the wafer was dried by blowing dry compressed air. The dishing state of the surface of the tungsten was measured by using a digital high definition microscope for ultra-depth profiling, "VK-8500", manufactured by Keyence Corporation.

The morphology of the processed surface of the polishing layer was measured according to the procedure taken for measuring other morphologies. The center depth of the tungsten interconnection was measured, and those yielding a measured value of 0.04 μm or less passed the test.

(Evaluation of Dishing 2)

Figure 2:
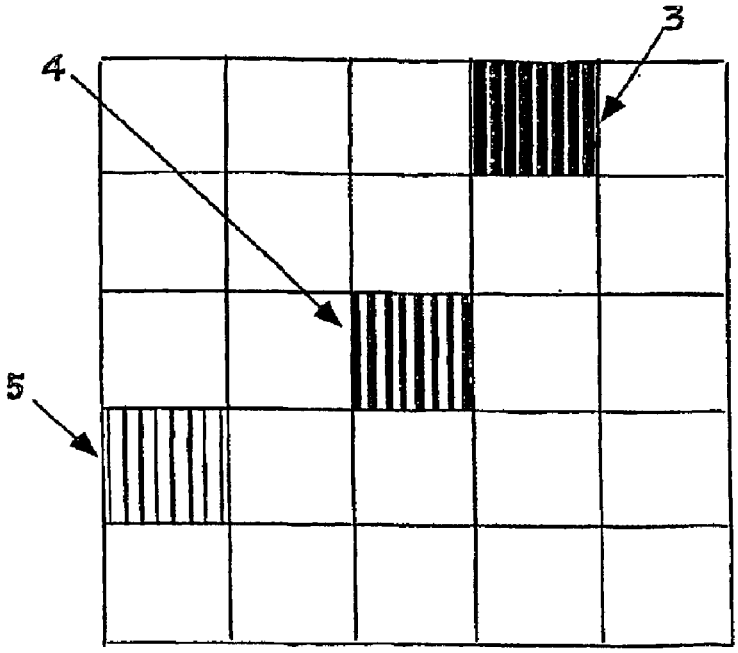
FIG. 2 is a diagram showing the interconnection pattern on an oxide film TEG.

Explanation is made by making reference to FIGS. 1 and 2. FIG. 1 is diagram showing schematically a 4-inch diameter wafer provided with an oxide film. The chip size is 10-mm square, and the chip pitch is 15 mm. Referring to FIG. 1, there is shown a center chip 1, and an edge chip 2. FIG. 2 is a diagram showing schematically an interconnection pattern of an oxide film TEG, in which an interconnection pattern within a chip having a interconnection step difference of 0.45 μm. There are shown 25 interconnection patterns (with 8 interconnection lines) each 2-mm square. Referring to the figure, shown are a pattern 3 with a protruded portion/concave portion=230/20 (μm), a pattern 4 with a protruded portion/concave portion=130/120 (μm), and a pattern 5 with a protruded portion/concave portion=20/230 (>m).

The evaluation of dishing was performed by forming chips on a wafer (a 4-inch dummy wafer CZP type, manufactured by Shin-Etsu Chemical Co., Ltd.) at various line densities as shown in FIGS. 1 and 2, and the polishing amount was measured on a 230-μm space portion (concave oxide film) by using "Lambda Ace" (VM-2000) manufactured by Dainippon Screen Mfg. Co., Ltd.

More specifically, the polishing pad to be tested was adhered to a platen of a polishing machine ("L/M-15E", manufactured by Lapmaster SFT Corp.), by first providing Rodel Inc., Suba400 as the cushion layer and by then using double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the fixing disk at a rotation of 25 rpm and rotating the conditioner at the same direction at a rotation of 25 rpm. The surface of the polishing pad was rinsed for 2 minutes while flowing pure water at a rate of 100 ml/min to the polishing machine, and subsequently, the wafer having provided with an oxide film and having the oxide film thickness measured on the 230-μm space portion and the 20-μm line portion (protruded portion) provided as a pair, was set to the polishing machine, and polishing was performed thereon under a pressing pressure of 0.04 MPa for 1 minute, while rotating the platen at a rotation of 45 rpm and rotating the conditioner at the same direction at a rotation of 45 rpm, and while supplying, at a rate of 100 ml/min, a slurry dispersion ("SC-1") manufactured by Cabot Microelectronics Corporation, having prepared at a concentration described in the instruction manual. In this case, the evaluation of the fixed abrasive pad was made by using an aqueous KOH solution of pH 10.5 instead of using slurry dispersion. Care was taken not to dry the surface of the wafer by immediately supplying pure water, and the wafer surface was cleaned by using a polyvinyl alcohol sponge. Then, the surface of the wafer was dried by blowing dry compressed air. The thickness of the oxide film provided on the surface of the 230-μm space portion and the 20-μm line portion provided as a pair was measured by using "Lambda Ace" (VM-2000) manufactured by Dainippon Screen Mfg. Co., Ltd.) to measure the amount polished. Polishing was repeated carefully until the step height became 10 nm or less. The dishing characteristics is better for the smaller amount of polishing (ideally, the value is 0) in the 230-μm space portion in case the step height became 10 nm or less. The test can be passed in case the amount of polishing falls in a range of 300 nm or less.

(Evaluation of Planarization Characteristics)

First, a test wafer for use in evaluating global step height was prepared in the following procedure.

Test wafer for use in evaluating global step height: A 10-mm square die was placed on a 4-inch silicon wafer provided with an oxide film (oxide film thickness: 2 μm). After performing mask exposure by using a photoresist, a line 20 μm in width and 0.7 μm in height was provided together with a space of 230 μm by means of RIE to the left half of the 10-mm square die in line-and-space arrangement, and a line 230 μm in width and 0.7 μm in height was provided together with a space of 20 μm to the right half in line-and-space arrangement.

A circular polishing layer 38 cm in diameter was prepared, and the surface thereof was subjected to a so-called X-Y groove processing (processing of lattice-like grooves) to provide grooves 2.0 mm in width, 0.5 mm in depth, and 15 mm in pitch. The resulting polishing pad was adhered to a fixing disk of a polishing machine ("L/M-15E", manufactured by Lapmaster SFT Corp.), by first providing Rodel Inc., "Suba400" as the cushion layer and by then using a double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the platen at a rotation of 25 rpm and rotating the conditioner at the same direction at a rotation of 25 rpm. The surface of the polishing pad was rinsed for 2 minutes while flowing pure water at a rate of 100 ml/min to the polishing machine, and subsequently, the test wafer for use in evaluating global step height was set to the polishing machine, and polishing was performed thereon for a predetermined time under a pressing pressure of 0.04 MPa, while rotating the platen at a rotation of 45 rpm (at a linear velocity at the center of the wafer of 3000 (cm/min)) and rotating a semi-conductor wafer holding table at the same direction at a rotation of 45 rpm, and while supplying, at a rate of 100 ml/min, a slurry ("SC-1") manufactured by Cabot Microelectronics Corporation having prepared at a concentration described in the instruction manual. Care was taken not to dry the surface of the wafer by immediately supplying pure water, and the wafer surface was cleaned by using a polyvinyl alcohol sponge. Then, the surface of the wafer was dried by blowing dry compressed air. The thickness of the oxide film of the 20-$\mu$m line and the 230-$\mu$m line in the center 10-mm die of the test wafer for evaluating global step height was measured for each by using "Lambda Ace" (VM-2000) manufactured by Dainippon Screen Mfg. Co., Ltd.), and the difference in thickness was evaluated as the global step height. The morphology of the processed surface of the polishing layer was measured according to the procedure taken for measuring other morphologies. Those yielding a global step difference of 45 nm or less between the 20-$\mu$m line region and the 230-$\mu$m line region in a polishing time of 5 minutes passed the test.

(Measurement of D Hardness)

Samples falling in a thickness range of from 1.0 mm to 1.5 mm (and having a size of 1-cm square or larger) were placed on a plane having such a surface hardness of D hardness value of 90 or higher, and D hardness was measured on 5 points by using a Durometer Type D (in practice, using "Askar D-type hardness meter" manufactured by Kobunshi Keiki Co., Ltd.) in accordance with JIS standard (hardness test) K6253. The measurement was carried out at room temperature (25° C.).

(Measurement of Flexural Modulus of Elasticity)

A rectangular test piece 1×8.5 cm in size and ranging from 1.0 mm to 1.5 mm in thickness was prepared from the polishing pad. Measurement of flexural modulus of elasticity was performed on the test piece in accordance with JIS-7203 by using a material testing machine (Tensilon RTM-100) manufactured by ORIENTEC Co., Ltd. The flexural modulus of elasticity was obtained in accordance with the equation as follows (wherein, the distances are given in units of millimeter):

Flexural modulus of elasticity={(Distance between supporting points)$^3$×(load (kgf) at a point arbitrarily selected from the linear portion in the initial part of the load–deflection curve)}/{4×(width of the test piece)×(thickness of the test piece)$^3$×(deflection on applying a load of F)}.

(Measurement of Water Absorptivity and Rate of Water Absorption)

The test piece (25×60 mm in size, any thickness) cut out from the polishing pad was subjected to vacuum drying at 80° C. for 10 hours, and was then immersed in pure water at room temperature. Test pieces were each taken out from pure water after 5 minutes, 30 minutes, 60 minutes, 3 hours, and 10 hours, and were each placed inside a centrifugal tube. Thus, centrifugal force ranging from 1400 G to 1450 G was applied to the tube for 30 minutes to drive out water. The hygroscopic weight was then measured on the resulting products.

Water absorptivity was obtained in accordance with the following equation:

Water absorptivity (%)={(hygroscopic weight at time 1)−(dry weight)}/(dry weight)×100.

Then, the rate of water absorption was obtained in accordance with the following equation, where time 1 and time 2 are taken in the unit of minutes:

Rate of water absorption (%/hr)=(Water absorptivity at time 2)−(Water absorptivity at time 1))×60/(time 2 −time 1).

More specifically, for instance, in case time 1 is 5 minutes and time 2 is 30 minutes, the average rate of water absorption can be obtained for a time interval of 5 minutes to 30 minutes from the initiation of moisture absorption. In the present patent, the average rate of moisture absorption up to 5 minutes was obtained.

(Measurement of Centerline Average Roughness Ra)

A circular polishing pad 38 cm in diameter and 1.2 mm in thickness was prepared, and a desired lattice-like groove patterning or dimple patterning was provided to the surface thereof. The resulting polishing pad was adhered to a platen of a polishing machine ("L/M-15E", manufactured by Lapmaster SFT Corp.), by first providing Rodel Inc., "Suba400" as the cushion layer and by then using a double-sided adhesive tape ("442J", manufactured by 3M com.) to adhere the pad thereon. Conditioning of the polishing pad was performed by using a conditioner ("CMP-M", 14.2 cm in diameter, manufactured by Asahi Diamond Industrial Co., Ltd.), under a pressing pressure of 0.04 MPa for 5 minutes and supplying pure water at a rate of 10 ml/min, while rotating the platen at a rotation of 25 rpm and rotating the conditioner at the same direction at a rotation of 25 rpm. The surface of the polishing pad was then rinsed for 2 minutes while flowing pure water at a rate of 100 ml/min to the polishing machine. Subsequently, by using a surface roughness meter ("Surfocorder SE-3300") produced by Kosaka Laboratory Inc., measurement was made for 8-mm length each at 5 points starting from a position 7 cm distant from the center of the polishing pad along the radius direction, and then increasing the distance every time by 1 cm. In case the measuring point fell on the groove, the measuring point was displaced for a minimal length. The measuring conditions followed those recommended by JIS (i.e., the cut off value was 0.8 mm, and the measuring speed was 0.1 mm/second). The average value of the observed values for 5 points was used as the Ra value. Then, the pad was adhered again to a platen of a polishing machine ("L/M-15E", manufactured by Lapmaster SFT Corp.), by first providing Rodel Inc., "Suba400" as the cushion layer and by then using a double-sided adhesive tape ("442J", manufactured by 3M com.) to adhere the pad thereon. A wafer having an oxide film provided thereon (a 4-inch dummy wafer CZP type, manufactured by Shin-Etsu Chemical Co., Ltd.) was set to the polishing machine, and polishing was performed thereon under a pressing pressure of 0.04 MPa for 5 minutes, while rotating the platen at a rotation of 45 rpm and rotating the conditioner at the same direction at a rotation of 45 rpm, and while supplying, at a rate of 100 ml/min, a slurry dispersion ("SC-1", manufactured by Cabot Microelectronics Corporation) having prepared at a concentration described in the instruction manual. The surface of the polishing pad was then rinsed for 2 minutes while flowing pure water at a rate of 100 ml/min to the polishing machine, and the centerline roughness Ra was measured in accordance with the procedure above (if necessary, this procedure is repeated for times corresponding to the number of wafer sheets).

(On the Effect of Water Supply Mechanism)

Example 1

Two sheets of filter paper 17 chr produced by Whatman Corporation were superposed, and were impregnated with a mixed solution containing 20 parts of polyvinyl pyrrolidone (having a molecular weight of 10000) and 80 parts of a 999/1 mixture of MMA (methyl methacrylate)/AIBN (azobis(isobutyronitrile)). The resulting product was interposed between glass sheets, and polymerization was carried out by placing them inside a hot bath of 65° C. for 5 hours. The polymerization was completed by allowing it to stand for 3 hours in a dryer held at 100° C. Dust adhesion test was carried out on the thus obtained resin sheet. As a result, 151 dust particles were observed, and the D hardness was found to be 83 degrees. The polishing rate of the oxide film was found to be 132 nm/min. The filter paper portion functioned as a water supplying mechanism, and the dust adhesion to the surface of the article to be polished was reduced. Further, the domain size was found to be $3.6\times10^{-5}$ $m^2$ under the microscope.

Example 2

A filter paper powder (E type) produced by ADVANTEK Co. Ltd. was uniaxially kneaded and compounded with "Surlyn" (1705, product of Mitsui DuPont Polychemicals, K.K.) at 165° C. in such a manner that the powder paper should account for 35% by weight. Pellets cut into 3 mm in length were hot pressed at 185° C. in a 40-cm square mold. The resin sheet thus obtained was subjected to a dust adhesion test.

As a result, 254 dust particles were observed, and the D hardness was found to be 63 degrees.

The polishing rate of the oxide film was found to be 32 nm/min. The powder of the filter paper functioned as a water supplying mechanism, and the dust adhesion to the surface of the article to be polished was reduced. Further, the domain size was found to be $4.3\times10^{-10}$ $m^2$ under the microscope.

Comparative Example 1

A 40-cm square "Axtar" (a product of Toray Industries, Inc.; a non-woven made of polyethylene terephthalate filaments, density 280 $g/m^2$) was impregnated with liquid phenolic resin (PR-53123, a product of Sumitomo Durez K.K.) at a dry weight ratio of 50 wt %, dried, and shaped at 170° C. for 20 minutes under pressure of 3.5 MPa to obtain a sheet 1.2 mm in thickness. As a result, 3234 dust particles were observed. The D hardness was found to be 90 degrees. The polishing rate of the oxide film was found to be 111 nm/min. The polyethylene terephthalate filaments were found impossible to function as a water supply mechanism, and the dust adhesion to the surface of the article to be polished could not be reduced.

Comparative Example 2

Hot press molding was performed by using a 40-cm square mold at 185° C. in a manner similar to that described in Example 2, except for using pellets of "Surlyn" in the place of filter paper powder. The dust adhesion test was performed on the thus obtained resin sheet. As a result, 3443 dust particles were observed. The D hardness was found to be 64 degrees. The polishing rate of the oxide film was found to be 35 nm/min. Because filter paper powder was used, it was found unable to establish a water supply mechanism domain, and the dust adhesion to the surface of the article to be polished could not be reduced.

(On the Effect of the Hydrophilic Polymers Substantially Insoluble to Water)

Example 3

A sheet of filter paper 17 chr produced by Whatman Corporation was impregnated with 999/1 mixed MMA (methyl methacrylate)/AIBN (azobis(isobutyronitrile)). The resulting product was interposed between glass sheets, and polymerization was carried out by placing them inside a hot bath of 65° C. for 5 hours. Then, the product was allowed to stand in a dryer at 100° C. for 3 hours to complete the polymerization. Dust adhesion test was performed on the resulting resin sheet. As a result, 201 dust particles were observed. The D hardness was found to be 88 degrees. The solubility parameter of the filter paper, i.e., cellulose, was found to yield δsp of 24.08 and δh of 11.85.

Example 4

A filter paper powder (E type) produced by ADVANTEK Co. Ltd. was uniaxially kneaded and compounded with "Surlyn" (1705, product of Mitsui DuPont Polychemicals, K.K.) at 165° C. in such a manner that the powder paper should account for 30% by weight. Pellets cut into 3 mm in length were hot pressed at 185° C. in a 40-cm square mold. The resin sheet thus obtained was subjected to a dust adhesion test.

As a result, 327 dust particles were observed, and the D hardness was found to be 63 degrees.

The polishing rate of the oxide film was found to be 35 nm/min. The solubility parameter of the filter paper, i.e., cellulose, was found to yield δsp of 24.08 and δh of 11.85.

Example 5

A 40-cm square "Kevlar" felt (product of Toray DuPont K.K., density 280 $g/m^2$) was impregnated with liquid phenolic resin (PR-53123, a product of Sumitomo Durez K.K.) at a dry weight ratio of 50 wt %, dried, and shaped at 170° C. for 20 minutes under pressure of 3.5 MPa to obtain a sheet 1.2 mm in thickness. As a result, 196 dust particles were observed. The D hardness was found to be 90 degrees. The polishing rate of the oxide film was found to be 88 nm/min. The solubility parameter of "Kevlar", i.e., an aromatic polyamide, was found to yield δsp of 15.89 and δh of 9.27.

Comparative Example 3

Similar to Example 1, a 999/1 mixture of MMA (methyl methacrylate)/AIBN (azobis(isobutyronitrile)) was polymerized between sheets without using a filter paper, and dust adhesion test was carried out by using the thus obtained resin sheet. As a result, 2291 dust particles were observed. The D hardness was found to be 91 degrees. The polishing rate of the oxide film was found to be 350 nm/min.

Comparative Example 4

Similar to Example 2, pellets of "Surlyn" were used without using filter paper powder, and were hot pressed at 185° C. in a 40-cm square mold. The resin sheet thus obtained was subjected to a dust adhesion test. As a result, 3443 dust particles were observed, and the D hardness was found to be 64 degrees. The polishing rate of the oxide film was found to be 35 nm/min.

(Particles and/or Fibrous Material Made of Hydrophilic Organic Material Having a Water Absorptivity of 5000% or Lower)

The evaluation results (flexular modulus of elasticity, D hardness, dust adhesion, polishing rate of oxide film, evaluation of planarization characteristics, and the measurement of dishing) obtained on Examples and Comparative Examples are shown in Table 1. The interstices were confirmed by using an optical microscope at a magnification of 50 times.

Example 6

A mixture comprising 35 parts by weight of polyvinyl polypyrrolidone (having nominal water content of 6% and water absorptivity of 2500%) and 65 parts by weight of a 999/1 mixture of MMA (methyl methacrylate)/AIBN (azobis(isobutyronitrile)) was polymerized between sheets, and a polishing pad 1.2 mm in thickness was produced from the resin sheet thus obtained. No interstices were found in polyvinyl polypyrrolidone.

Example 7

A mixture comprising 33 parts by weight of polyvinyl polypyrrolidone (having nominal water content of 6% and water absorptivity of 2500%), 64 parts by weight of a 999/1 mixture of MMA (methyl methacrylate)/AIBN (azobis (isobutyronitrile)), and 3 parts by weight of silica particles 1 μm in particle diameter was polymerized between sheets, and a polishing pad was produced from the resin sheet thus obtained. No interstices were found in polyvinyl polypyrrolidone.

Example 8

A 35 parts by weight portion of a filter paper powder (E type, having nominal water content of 10% and water absorptivity of 500%) produced by ADVANTEK Co. Ltd. was mixed with 65 parts by weight of a material containing mixed therein "Artfirmer" (TA-1327, produced by Sanyo Chemical Industries, Inc.) at a predetermined mixing ratio, and the resulting mixture was fed inside a 40-cm square mold. After defoaming at 100° C., the product was heated at 165° C. to obtain a resin sheet. A polishing pad 1.2 mm in thickness was produced from the thus obtained resin sheet. On observing the cross section with an optical microscope, no interstices were found in the filter paper powder.

Example 9

Sixty-two parts by weight of a two-part polyurethane resin C-4403 (a product of Nippon Polyurethane K.K.) was kneaded together with 38 parts by weight of N-4276 (a product of Nippon Polyurethane K.K.), and after kneading the resulting product with 33 parts by weight of polyvinyl polypyrrolidone (having nominal water content of 6% and water absorptivity of 2500%), the product was hardened in a mold after subjecting it to vacuum degassing. Thus was obtained a 1.2 mm thick polyurethane sheet. A polishing pad was produced from the resin sheet thus obtained. On observing the cross section with an optical microscope, no interstices were found in polyvinyl polypyrrolidone.

Example 10

Seventeen parts by weight of powdered filter paper (KC-FLOCK produced by Nippon Papermaking Industry Co., Ltd., 400-mesh size, having nominal water content of 11% and water absorptivity of 500%) was kneaded with a liquid phenolic resin (PR-53717, a product of Sumitomo Durez K.K.) to yield a dry weight ratio of 83 parts by weight, and after drying, the product was shaped under pressure of 3.5 MPa at 170° C. for 20 minutes to obtain a sheet 1.2 mm in thickness. A polishing pad was produced from the resin sheet thus obtained. On observing the cross section with an optical microscope, no interstices were found in the powdered filter paper.

Example 11

A 1.2 mm thick polishing pad was produced in the same manner as in Example 10, except for mixing, in addition to the powdered filter paper, 3 parts by weight of silica particles having a diameter of 1 μm, and for kneading the resulting mixture with a liquid phenolic resin (PR-53717, a product of Sumitomo Durez K.K.) to yield a dry weight of 80 parts by weight. On observing the cross section with an optical microscope, no interstices were found in the powdered filter paper.

Example 12

Forty parts by weight of Nylon 6 particles having a diameter of 5 μm (and having nominal water content of 4.5% and water absorptivity of 22%) was kneaded with a liquid phenolic resin (PR-55123, a product of Sumitomo Durez K.K.) to yield a dry weight ratio of 60 parts by weight, and after drying, the product was shaped under pressure of 4 MPa at 170° C. for 20 minutes to obtain a sheet 1.2 mm in thickness. A polishing pad was produced from the resin sheet thus obtained. On observing the cross section with an optical microscope, no interstices were found in the Nylon particles.

Example 13

Forty-five parts by weight of polyacrylonitrile fibers having a diameter of 13 μm and cut into length of 100 μm (a product of Toray Industries, Inc., having nominal water content of 2% and water absorptivity of 15%) were kneaded together with 55 parts by weight of phenolic resin (BRP-5980, a product of Showa Highpolymer Co., Ltd.). The resulting product was fed inside a 40-cm square mold, and was shaped under pressure of 3.5 MPa at 185° C. for 20 minutes to obtain a sheet 1.2 mm in thickness. A polishing pad was produced from the resin sheet thus obtained. On observing the cross section with an optical microscope, no interstices were found in the polyacrylonitrile fibers.

Example 14

A polyurethane block (normal water content: 1%, water absorptivity: 3.5%) was ground to have a size such that it passed through a 300-mesh filer. Forty-five parts by weight of this polyurethane block was knead with 55 parts by weight of a phenolic resin (BRP-5980), a product of Showa Highpolymer Co., Ltd.). The mixture was poured into a 40-cm square mold and shaped under a pressure of 3.5 MPa at 185° C. for 20 minutes to obtain a sheet having a thickness of 1.2 mm. A polished pad was produced from the resin sheet thus obtained. On observing the cross section with an optical microscope, no interstices were found in the polyurethane particles.

Examples 15 to 20

The same procedures as described in Examples 8 to 13 were followed to obtain 1.2 mm thick polishing resin sheets each, except for adding 0.2 parts by weight each of xanthane rubber as a hydrophilic water-soluble resin.

Example 21

The same procedure as described in Example 10 was followed, except for controlling pressure reduction during shaping the resin sheet to form interstices in the powdered filter paper and the phenolic resin. A polishing pad was produced from the thus obtained resin sheet.

Example 22

The same procedure as described in Example 21 was followed to obtain a shaped resin sheet, except for mixing, in addition to the powdered filter paper, 30 parts by weight of silica particles having a diameter of 1 μm. A polishing pad was produced from the thus obtained resin sheet.

Example 23

A polishing resin sheet was fabricated by following the same procedure as that described in Example 10, except for further adding 7 parts by weight of xanthane rubber as a hydrophilic water-soluble resin. On observing the cross section with an optical microscope, interstices were found in the powdered filter paper.

Comparative Example 5

Sanfresh ST10OMPS (manufactured by Sanyo Chemical Industries, Ltd., having water absorptivity of 10000%) was impregnated with liquid phenolic resin (PR-55123, a product of Sumitomo Durez K.K.) to yield a dry weight ratio of 50 parts by weight, and, after drying, the product was shaped under pressure of 3.5 MPa at 170° C. for 20 minutes to obtain a sheet 1.2 mm in thickness. A polishing pad was produced from the resin sheet thus obtained. Large amount of swelled Sanfresh was observed to adhere on the wafer during polishing, and clean surface could not be maintained. On observing the cross-section with an optical microscope, no interstices were found in Sanfresh.

Comparative Example 6

Hydrophobic polyethylene terephthalate fibers (having nominal water content of 0.4%, a diameter of 13 μm, and a length of 100 μm) were impregnated with liquid phenolic resin (PR-55123, a product of Sumitomo Durez K.K.) to yield a dry weight ratio of 50 parts by weight, and, after drying, the product was shaped under pressure of 3.5 MPa at 170° C. for 20 minutes to obtain a sheet 1.2 mm in thickness. It was found unfeasible to reduce dust adhesion to the surface of the article being polished. On observing the cross section with an optical microscope, no interstices were found in the polyethylene terephthalate fibers.

Comparative Example 7

A 3.5-parts by weight portion of urethane particles described in Example 9 was mixed with 96.5 parts by weight of a 999/1 mixture of MMA (methyl methacrylate)/AIBN (azobis(isobutyronitrile)), and the resulting product was allowed to polymerize between plates. A 1.2 mm thick polishing pad was produced from the resin sheet thus obtained. Interstices were observed in the urethane particles.

Comparative Example 8

The same procedure as described in Examples 6 was followed, except for mixing 3.5-parts by weight of polyvinyl polypyrrolidone with 96.5 parts by weight of a 999/1 mixture of MMA (methyl methacrylate)/AIBN (azobis (isobutyronitrile)), and for allowing the resulting product to polymerize between plates. A 1.2 mm thick polishing pad was produced from the resin sheet thus obtained. No interstices were observed in polyvinyl polypyrrolidone.

TABLE 1

| | | Flexural Modulus of Elasticity (GPa) | D hardness (degrees) | Dust adhesion (particles) | Scratch flaws (counts) | Polishing rate of Oxide film (nm/min) | Evaluation of Planrization (Polishing time/step height) (min/nm) | Measurement of Dishing (um) |
|---|---|---|---|---|---|---|---|---|
| Examples | 6 | 4 | 89 | 301 | 0 | 199 | 5/34 | 0.03 |
| | 7 | 9 | 91 | 321 | 2 | 208 | 4/32 | 0.02 |
| | 8 | 3 | 85 | 258 | 1 | 112 | 5/42 | 0.04 |
| | 9 | 2 | 77 | 289 | 2 | 108 | 5/32 | 0.04 |
| | 10 | 6 | 89 | 299 | 4 | 87 | 5/22 | 0.03 |
| | 11 | 12 | 92 | 335 | 5 | 107 | 4/29 | 0.02 |
| | 12 | 5 | 89 | 248 | 2 | 99 | 4/34 | 0.03 |
| | 13 | 5 | 89 | 315 | 1 | 116 | 4/35 | 0.03 |
| | 14 | 5 | 89 | 356 | 2 | 118 | 4/36 | 0.03 |
| | 15 | 3 | 89 | 301 | 0 | 205 | 5/36 | 0.03 |
| | 16 | 9 | 91 | 321 | 2 | 216 | 4/34 | 0.02 |
| | 17 | 3 | 85 | 258 | 1 | 127 | 5/42 | 0.04 |
| | 18 | 2 | 77 | 289 | 2 | 115 | 5/35 | 0.04 |
| | 19 | 6 | 89 | 299 | 4 | 92 | 5/28 | 0.03 |
| | 20 | 11 | 92 | 335 | 5 | 114 | 5/22 | 0.02 |
| | 21 | 6 | 89 | 301 | 4 | 107 | 5/29 | 0.03 |
| | 22 | 13 | 93 | 355 | 4 | 132 | 4/28 | 0.02 |
| | 23 | 5 | 87 | 265 | 2 | 83 | 5/22 | 0.03 |
| Comp | 5 | 4 | 88 | 426 | 2 | 79 | 5/88 | 0.05 |
| Ex | 6 | 4 | 88 | 3,426 | 13 | 84 | 5/88 | 0.05 |
| | 7 | 4 | 89 | 4,331 | 321 | 259 | 5/31 | 0.03 |
| | 8 | 4 | 89 | 3,884 | 284 | 279 | 5/34 | 0.03 |

(Effect of Mixing Sheet-like Materials)

The evaluation results (flexural modulus of elasticity, D hardness, dust adhesion, polishing rate of oxide film, evaluation of planarization characteristics, and measurement of dishing 1) obtained on Examples and Comparative Examples are given in Table 2. The interstices were confirmed by using optical microscope at a magnification of 50 times.

Example 24

Two sheets of filter paper 17chr (having nominal water content of 11% and a dry thickness of 0.9 mm) produced by Whatman Corporation were superposed, and the resulting product was impregnated with 65 parts of a 999/1 mixture of MMA (methyl methacrylate)/AIBN (azobis (isobutyronitrile)). The resulting product was interposed between glass sheets, and polymerization was carried out by placing them inside a hot bath of 65° C. for 5 hours. The polymerization was completed by allowing it to stand for 3 hours in a dryer held at 100° C. A polishing pad was produced from the thus obtained resin sheet. On observing the cross section with an optical microscope, no interstices were observed in the filter paper.

Example 25

Two sheets of filter paper 17 chr (having nominal water content of 11% and a dry thickness of 0.9 mm) produced by Whatman Corporation were superposed, and the resulting product was impregnated with liquid phenolic resin (PR-55123, a product of Sumitomo Durez K.K.) to yield a dry weight ratio of 50 parts by weight. After drying, the resulting product was shaped under pressure of 3.5 MPa at 170° C. for 20 minutes to obtain a sheet 1.8 mm in thickness. A 1.2 mm thick polishing pad was produced from the thus obtained resin sheet. On observing the cross section with an optical microscope, no interstices were observed in the filter paper.

Example 26

A craft paper (having nominal water content of 10%) 0.18 mm in thickness was impregnated with a liquid phenolic resin (PR-55123, a product of Sumitomo Durez K.K.) to yield a dry weight ratio of 50 parts by weight. After drying, six sheets of the paper were superposed, and the resulting product was shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the craft paper.

Example 27

Fifty-one parts by weight of two-part polyurethane resin C-4421 (manufactured by Nippon Polyurethane Industry Co., Ltd.) was kneaded with 49 parts by weight of N-4276 (manufactured by Nippon Polyurethane Industry Co., Ltd.), and a cellulose sponge (a product of Toray Fine Chemicals, Inc., having nominal water content of 11% and a dry-compressed thickness of 1 mm) was impregnated with the resulting product to yield a weight ratio of 25 parts by weight. After defoaming in vacuum, the resulting product was hardened in a mold to produce a polyurethane sheet 1.2 mm in thickness. A polishing pad was produced from the resin sheet thus obtained. On observing the cross section with an optical microscope, no interstices were observed in the cellulose sponge.

Example 28

Thirty parts by weight of a Nylon woven material (300 μm in thickness and having nominal water content of 4.5%) was impregnated with liquid phenolic resin (PR-53717, a product of Sumitomo Durez K.K.) to yield a dry weight ratio of 70 parts by weight. After drying, 4 sheets of the resulting product were superposed and shaped under pressure of 3.5 MPa at 170° C. for 20 minutes to obtain a sheet 1.2 mm in thickness. A polishing pad was produced from the thus obtained resin sheet. On observing the cross section with an optical microscope, interstices were observed in the Nylon woven material.

Example 29

Thirty parts by weight of a cotton woven material (300 μm in thickness and having nominal water content of 10%) was impregnated with liquid phenolic resin (PR-53717, a product of Sumitomo Durez K.K.) to yield a dry weight ratio of 70 parts by weight. After drying, 4 sheets of the resulting product were superposed and shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the cotton woven material.

Example 30

Sixty-five parts by weight of a material containing mixed therein "Artfirmer" (TA-1327, produced by Sanyo Chemical Industries, Inc.) at a predetermined mixing ratio was mixed with a craft paper 0.24 mm in thickness (having nominal water content of 10%), and 5 sheets of the resulting product were superposed and placed inside a 40-cm square mold. After defoaming at 100° C., the resulting product was heated at 165° C. to obtain a resin sheet. A polishing pad was produced with the resin sheet thus obtained. On observing the cross section with an optical microscope, no interstices were observed in the craft paper.

Example 31

Three sheets each of the prepregs produced in Examples 26 and 30 before shaping were superposed alternately with "Artfirmer" in such a manner that "Artfirmer" may become on the upper side, and after shaping a resin sheet similarly, a polishing pad was produced therefrom. No interstices were found in the craft paper.

Example 32

Three sheets each of the prepregs produced in Examples 26 and 28 before shaping were superposed alternately in such a manner that the craft paper may be disposed on the upper side, and after shaping a resin sheet similarly, a polishing pad was produced therefrom. No interstices were found in the craft paper and the Nylon woven material.

Example 33

Similar procedure as that described in Example 32 was followed, except for placing a 4 μm thick polyethylene terephthalate film under the prepregs produced in Examples 26 and 28. Three sets of such arrangement were alternately stuck to shape a 9-layred resin sheet. No interstices were found in the craft paper and the Nylon woven material.

Example 34

The same procedure as that described in Example 26 was followed to produce a polishing pad, except for using, as a matrix resin, a liquid phenolic resin (PR-55123, a product of Sumitomo Durez K. K.) containing mixed therein 3 parts by weight of silica particles having a diameter of 1 μm. On observing the cross section with an optical microscope, no interstices were observed in the craft paper.

Example 35

The same procedure as that described in Example 34 was followed to produce a polishing pad, except for using a liquid phenolic resin (PR-55123, a product of Sumitomo Durez K.K.) containing mixed therein 30 parts by weight of silica particles. On observing the cross section with an optical microscope, no interstices were observed in the craft paper.

Examples 36 to 38

The same procedures as described in Examples 33 to 35 were followed to obtain polishing resin sheets each, except for adding 0.4 parts by weight each of xanthane rubber as a hydrophilic water-soluble resin. No interstices were observed in each of the resulting products.

Example 39

The same procedure as described in Example 33 was followed, except for controlling pressure reduction during shaping the resin sheet to form interstices in the craft paper. A polishing pad was produced from the thus obtained resin sheet.

Example 40

The same procedure as described in Example 33 was followed, except for controlling pressure reduction during shaping the resin sheet to form interstices in both of the craft paper and the phenolic resin. A polishing pad was produced from the thus obtained resin sheet.

Example 41

A woven material of polyacrylonitrile fibers (produced by Toray Industries, Inc., 300 $\mu$m thick and having nominal water content of 2%) was impregnated with a liquid phenolic resin (PR-53717, a product of Sumitomo Durez K.K.) in such a manner to yield a dry weight of 55 parts by weight. After drying, 4 sheets of the resulting product were superposed, and were shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the woven material of polyacrylonitrile fibers.

Example 42

A woven material of thermoplastic urethane fibers (300 $\mu$m thick, 13 $\mu$m in fiber diameter, and having nominal water content of 1%) was impregnated with a liquid phenolic resin (PR-53717, a product of Sumitomo Durez K.K.) in such a manner to yield a dry weight of 55 wt %. After drying, 4 sheets of the resulting product were superposed, and were shaped under pressure of 3.5 MPa at 170° C. for 20 minutes to obtain a sheet 1.2 mm in thickness. A polishing pad was produced from the thus obtained resin sheet. On observing the cross section with an optical microscope, interstices were observed in the woven material of polyurethane fibers.

Example 43

A polishing resin sheet was fabricated by following the same procedure as that described in Example 33, except for further adding 5 parts by weight of xanthane rubber as a hydrophilic water-soluble resin. No interstices were found.

Example 44

Thirty parts by weight of a 0.24 mm thick craft paper (having nominal water content of 10%) was impregnated with molten polypropylene, and the interstices thereof were coated with liquid phenolic resin (PR-53717, a product of Sumitomo Durez K.K.) at a thickness of 2 $\mu$m. Five sheets of the resulting product were placed together inside a 40-cm square mold, and were subjected to pressing at 190° C. A polishing pad was produced from the thus obtained resin sheet. On observing the cross section with an optical microscope, no interstices were observed in the craft paper.

Example 45

A 0.24 mm thick craft paper (having nominal water content of 10%) was impregnated with a melt kneaded 95/5 (weight ratio) mixture of polypropylene and silica particles having pores 1 $\mu$m in pore diameter in such a manner that in total they become 30 parts by weight. Five sheets of the resulting product were placed together inside a 40-cm square mold, and were subjected to pressing at 190° C. A polishing pad was produced from the thus obtained resin sheet. On observing the cross section with an optical microscope, no interstices were observed in the craft paper.

Comparative Example 9

Anon-woven cloth of polyethylene terephthalate filaments (a product of Toray Industries, Inc., having a density of 100 g/m$^2$ and nominal water content of 0.4%, with filament diameter of 13 $\mu$m) was impregnated with liquid phenolic resin (PR-55123, a product of Sumitomo Durez K.K.) in such a manner that the weight ratio may become 4 parts by weight. After drying, 5 sheets of the resulting product were shaped under pressure of 3.5 MPa at 170° C. for 20 minutes to obtain a sheet 1.4 mm in thickness. A polishing pad was produced from the thus obtained resin sheet. On observing the cross section with an optical microscope, no interstices were observed in the non-woven cloth of polyethylene terephthalate filaments.

Comparative Example 10

Five sheets of non-woven cloth of polyethylene terephthalate filaments (a product of Toray Industries, Inc., having a density of 100 g/m$^2$ and nominal water content of 0.4%, with filament diameter of 13 $\mu$m) were superposed, and after mixing therein 60 parts by weight of a 999/1 mixture of MMA (methyl methacrylate)/AIBN (azobis (isobutyronitrile)), polymerization between sheets was performed at a weight ratio of 40%. A polishing pad was produced from the thus obtained resin sheet. On observing the cross section with an optical microscope, no interstices were observed in the non-woven cloth of polyethylene terephthalate filaments.

TABLE 2

| | | Flexural Modulus of Elasticity (GPa) | D hardness (degrees) | Dust adhesion (particles) | Scratch flaws (counts) | Polishing rate of Oxide film (nm/min) | Evaluation of Planrization (Polishing time/step height) (min/nm) | Measurement of Dishing (um) |
|---|---|---|---|---|---|---|---|---|
| Examples | 24 | 4.6 | 90 | 289 | 3 | 183 | 5/30 | 0.03 |
| | 25 | 9.3 | 91 | 261 | 2 | 83 | 5/38 | 0.04 |
| | 26 | 8.6 | 90 | 244 | 1 | 82 | 5/38 | 0.04 |
| | 27 | 3.5 | 77 | 289 | 2 | 102 | 5/33 | 0.04 |
| | 28 | 5.8 | 89 | 364 | 8 | 108 | 5/31 | 0.03 |
| | 29 | 5.7 | 90 | 268 | 2 | 87 | 5/35 | 0.04 |
| | 30 | 6.2 | 86 | 258 | 1 | 78 | 4/42 | 0.03 |
| | 31 | 6.0 | 90 | 244 | 0 | 88 | 5/33 | 0.03 |
| | 32 | 5.1 | 89 | 356 | 2 | 96 | 4/36 | 0.03 |
| | 33 | 6.5 | 89 | 287 | 0 | 101 | 5/31 | 0.03 |
| | 34 | 9.5 | 90 | 258 | 2 | 112 | 4/40 | 0.03 |
| | 35 | 15.3 | 93 | 288 | 6 | 142 | 4/32 | 0.03 |
| | 36 | 8.3 | 89 | 241 | 1 | 84 | 5/31 | 0.04 |
| | 37 | 9.2 | 90 | 255 | 2 | 110 | 4/28 | 0.03 |
| | 38 | 14.5 | 93 | 281 | 5 | 132 | 4/22 | 0.02 |
| | 39 | 5.8 | 87 | 235 | 2 | 85 | 5/38 | 0.04 |
| | 40 | 5.8 | 86 | 223 | 1 | 93 | 5/38 | 0.04 |
| | 41 | 5.5 | 89 | 315 | 1 | 116 | 5/35 | 0.03 |
| | 42 | 5.8 | 89 | 356 | 2 | 118 | 5/36 | 0.03 |
| | 43 | 7.6 | 87 | 228 | 1 | 80 | 5/31 | 0.03 |
| | 44 | 3.4 | 75 | 287 | 1 | 70 | 5/38 | 0.04 |
| | 45 | 3.5 | 76 | 305 | 2 | 73 | 5/37 | 0.04 |
| Comp | 9 | 4.4 | 88 | 3,426 | 38 | 84 | 5/88 | 0.05 |
| Ex. | 10 | 3.5 | 89 | 4,331 | 321 | 259 | 5/31 | 0.03 |

(On the Mixing Effect of Fibrous Materials Having an Aspect Ratio of 5 or Higher and/or Particles Formed from the Composites Thereof)

The evaluation results (flexular modulus of elasticity, D hardness, dust adhesion, polishing rate of oxide film, evaluation of planarization characteristics, and the measurement of dishing) obtained on Examples and Comparative Examples are shown in Table 3. The interstices were confirmed by using an optical microscope at a magnification of 50 times.

Example 46

Thirty-five parts by weight of ultrafine fibers having a core and sheath structure (30 $\mu$m in diameter, comprising polystyrene for the matrix, and having nominal water content of 5%) using polyvinyl alcohol as the core and cut to a length of 3 mm (having an aspect ratio of 100) was mixed with 65 parts by weight of a 999/1 mixture of MMA (methyl methacrylate)/AIBN (azobis(isobutyronitrile)), and polymerization between sheets was performed thereon. A polishing pad, was produced from the resulting resin sheet. On observing the cross section with an optical microscope, no interstices were observed in the fibers made of polyvinyl alcohol.

Example 47

A powdered filter paper (having nominal water content of 11%) manufactured by Tosco Co., Ltd. was uniaxially kneaded at 160° C. with polypropylene (manufactured by Mitsubishi Chemicals Co., Ltd.) to obtain a compound in such a manner that the former may account for 18 wt %. The powdered filter paper manufactured by Tosco Co., Ltd. is such obtained by cutting linen at a length of about 25 $\mu$m, and exhibits fibril structure about 1 $\mu$m in thickness (with aspect ratio of about 25). By using pellets cut to a length of 3 mm, hot press molding was performed at 185° C. by using a 40-cm square mold. A polishing pad was produced from the resin sheet thus obtained. On observing the cross section with an optical microscope, no interstices were observed in the powdered filter paper.

Example 48

A powdered filter paper (having nominal water content of 11% and an aspect ratio of about 25) manufactured by Tosco Co. Ltd. was impregnated with liquid phenolic resin (PR-55123, a product of Sumitomo Durez K.K.) in such a manner that the dry weight ratio may become 55 parts by weight. After drying, the resulting product was shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the powdered filter paper.

Example 49

A powdered filter paper (having nominal water content of 11% and an aspect ratio of about 25) manufactured by Tosco Co., Ltd. was mixed with 45 parts by weight of a material containing mixed therein "Artfirmer" (TA-1327, produced by Sanyo Chemical Industries, Inc.) at a predetermined mixing ratio, and the resulting mixture was fed inside a 40-cm square mold. After defoaming at 100° C., the product was heated at 165° C. to obtain a resin sheet. A polishing pad was produced from the thus obtained resin sheet. On observing the cross section with an optical microscope, no interstices were found in the powdered filter paper.

Example 50

Forty parts by weight of ultrafine fibers having a core and sheath structure (30 $\mu$m in diameter, comprising polystyrene for the matrix, and having nominal water content of 5%) using Nylon 66 as the core and cut to a length of 3 mm (having an aspect ratio of about 100) was mixed with 60 parts by weight of a material containing mixed therein "Artfirmer" (TA-1327, produced by Sanyo Chemical Industries, Inc.) at a predetermined mixing ratio, and the resulting mixture was fed into a 40-cm square mold. After defoaming at 100° C., the product was heated at 165° C. to obtain a resin sheet. A polishing pad was produced from the thus obtained resin sheet. On observing the cross section with an optical microscope, no interstices were found in the ultrafine fibers having a core and sheath structure using Nylon 66 as the core.

Example 51

Thirty-five parts by weight of wool (having nominal water content of 15%) cut to a length of 3 mm was mixed with 65 parts by weight of a kneaded product obtained from 51 parts by weight of a two-part polyurethane resin C-4421 (manufactured by Nippon Polyurethane Industry Co., Ltd.) and 49 parts by weight of N-4276 (manufactured by Nippon Polyurethane Industry Co., Ltd.). After vacuum defoaming, the product was fed into a 40-cm square mold and heated at 85° C. to obtain a resin sheet. On observing the cross section with an optical microscope, no interstices were found in the wool.

Example 52

Eighteen parts by weight of a powdered filter paper (having nominal water content of 11% and an aspect ratio of about 250) manufactured by Tosco Co., Ltd. was kneaded with liquid phenolic resin (PR-53717, a product of Sumitomo Durez K.K.) in such a manner that the dry weight may become 82 parts by weight. After drying, the resulting product was shaped under pressure of 4 MPa at 170° C. for 20 minutes to obtain a sheet 1.2 mm in thickness. A polishing pad was produced from the thus obtained resin sheet. On observing the cross section with an optical microscope, interstices were observed in the powdered filter paper.

Example 53

A powdered filter paper (having nominal water content of 11% and an aspect ratio of about 250) manufactured by Tosco Co., Ltd. was uniaxially kneaded at 160° C. with polypropylene (manufactured by Mitsubishi Chemicals Co., Ltd.) to obtain a compound in such a manner that the former may account for 2.5 wt %. By using pellets cut to a length of 3 mm, hot press molding was performed at 185° C. by using a 40-cm square mold. A polishing pad was produced from the resin sheet thus obtained. On observing the cross section with an optical microscope, no interstices were observed in the powdered filter paper.

Example 54

The same procedure as that described in Example 48 was followed, except for mixing, in addition to the powdered filter paper, 3 parts by weight of silica particles having pores 1 μm in pore diameter. A resin sheet was shaped, and a polishing pad was produced from the resulting resin sheet. On observing the cross section with an optical microscope, no interstices were found in the powdered filter paper.

Examples 55 to 60

The same procedures as described in Examples 46 to 48, as well as 50 to 52 were followed to obtain polishing pad each, except for adding 0.8 parts by weight each of xanthane rubber as a hydrophilic water-soluble resin.

Example 61

Eighteen parts by weight of a powdered filter paper (having nominal water content of 11% and an aspect ratio of about 250) manufactured by Tosco Co., Ltd. was mixed with 3 parts by weight of silica particles having pores 1 μm in pore diameter, and the resulting product was impregnated with liquid phenolic resin (PR-53717, a product of Sumitomo Durez K.K.) in such a manner that the dry weight ratio may become 79 parts by weight. After drying, the resulting product was shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the powdered filter paper.

Example 62

Forty parts by weight of ultrafine fibers having a core and sheath structure (30 μm in diameter, comprising polystyrene for the matrix, and having nominal water content of 5%) using Nylon 66 as the core and cut to a length of 3 mm (having an aspect ratio of 100) was mixed with 30 parts by weight of silica particles having pores 1 μm in pore diameter, and the resulting product was mixed with liquid phenolic resin (PR-55123, a product of Sumitomo Durez K.K.) at a dry weight of 30 parts by weight. The mixture was then fed into a 40-cm square mold, and after drying at 70° C., the product was heated at 165° C. to obtain a resin sheet. A polishing pad was produced from the thus obtained resin sheet. On observing the cross section with an optical microscope, interstices were found in the ultrafine fibers having a core and sheath structure using Nylon 66 as the core.

Example 63

The same procedure as described in Example 52 was followed, except for controlling pressure reduction during shaping the resin sheet to form interstices in the craft paper. A polishing pad was produced from the thus obtained resin sheet.

Example 64

A polishing resin sheet was fabricated by following the same procedure as that described in Example 52, except for further adding 2 parts by weight of xanthane rubber as a hydrophilic water-soluble resin. A polishing pad was produced from thus obtained resin sheet. On observing the cross section with an optical microscope, interstices were found in the powdered filter paper.

Comparative Example 11

Polyethylene terephthalate fiber (a product of Toray Industries, Inc., having a pore diameter of 13 μm and cut to a length of 13 μm, with an aspect ratio of 1 and nominal water content of 0.4%) was mixed with liquid phenolic resin (PR-55123, a product of Sumitomo Durez K.K.) at a dry weight of 45 parts by weight. The resulting product was then shaped under pressure of 3.5 MPa at 170° C. for 20 minutes to obtain a sheet 1.2 mm in thickness. A polishing pad was produced from the thus obtained resin sheet. On observing the cross section with an optical microscope, no interstices were observed in the powdered filter paper. No interstices were observed in the matrix.

Comparative Example 12

Polypropylene fiber (having a normal water content of 0% a diameter of 13 μm and a length of 100 μm, with an aspect ratio of 7.7) was mixed with 97.5 parts by weight of a 999/1 mixture of MMA (methyl methacrylate)/AIBN (azobis (isobutyronitrile)), and the resulting product was allowed to polymerize between plates. A polishing pad was produced from the resin sheet thus obtained. On observing the cross section with an optical microscope, no interstices were observed in the polypropylene fibers.

1.2 mm in thickness, 2.0 mm in width, 0.5 mm in depth, and 15 mm in pitch) was subjected to a dust adhesion test. As a result, 208 dusts were observed. The D hardness was found to be 63 degrees. The polishing rate of oxide films as 113 nm/min. On evaluating dishing as a conventional pad, an unfavorable value of 396 nm was obtained. Measurement

TABLE 3

| | | Flexural Modulus of Elasticity (GPa) | D hardness (degrees) | Dust adhesion (particles) | Scratch flaws (counts) | Polishing rate of Oxide film (nm/min) | Evaluation of Planrization (Polishing time/step height) (min/nm) | Measurement of Dishing (um) |
|---|---|---|---|---|---|---|---|---|
| Examples | 46 | 2.6 | 89 | 313 | 2 | 213 | 5/34 | 0.04 |
| | 47 | 0.8 | 73 | 244 | 2 | 62 | 5/45 | 0.04 |
| | 48 | 3.6 | 89 | 334 | 1 | 87 | 5/33 | 0.04 |
| | 49 | 2.7 | 85 | 229 | 1 | 109 | 5/34 | 0.04 |
| | 50 | 2.8 | 86 | 258 | 2 | 116 | 5/33 | 0.04 |
| | 51 | 2.1 | 77 | 211 | 0 | 116 | 5/33 | 0.04 |
| | 52 | 5.7 | 89 | 299 | 2 | 103 | 5/29 | 0.03 |
| | 53 | 0.8 | 73 | 335 | 3 | 66 | 5/45 | 0.04 |
| | 54 | 5.2 | 89 | 248 | 2 | 99 | 4/34 | 0.03 |
| | 55 | 2.6 | 88 | 295 | 2 | 213 | 5/36 | 0.03 |
| | 56 | 0.8 | 73 | 221 | 2 | 62 | 4/34 | 0.02 |
| | 57 | 3.6 | 90 | 258 | 1 | 87 | 5/42 | 0.04 |
| | 58 | 2.6 | 85 | 238 | 1 | 112 | 5/31 | 0.04 |
| | 59 | 2.1 | 76 | 187 | 0 | 108 | 5/30 | 0.03 |
| | 60 | 5.7 | 89 | 269 | 2 | 87 | 5/22 | 0.03 |
| | 61 | 6.2 | 90 | 283 | 3 | 107 | 4/29 | 0.03 |
| | 62 | 10.5 | 92 | 299 | 4 | 114 | 4/27 | 0.03 |
| | 63 | 5.6 | 89 | 288 | 2 | 105 | 5/29 | 0.04 |
| | 64 | 5.1 | 87 | 223 | 2 | 85 | 5/20 | 0.03 |
| Comp | 11 | 3.8 | 90 | 3,473 | 11 | 74 | 5/44 | 0.05 |
| Ex | 12 | 3.5 | 89 | 4,331 | 321 | 259 | 5/31 | 0.03 |

(On the Effect of Nanocomposites)

Example 65

Nanocomposite was prepared by mixing silica particles 70 nm in diameter at a weight ratio of 40 wt % with polyhexamethyleneazipamide. The 30:40:30 mixture of the nanocomposite/polyhexamethyleneazipamide/ADVANTEK powdered filter paper (E type) thus prepared was shaped by hot pressing at 200° C. for 15 minutes using a 40-cm square mold. The dust adhesion test was performed on the thus obtained resin sheet. As a result, 251 dust particles were found. The D hardness was 93 degrees. The polishing rate of oxide film was 152 nm/min. On evaluating dishing as fixed abrasive pad, a favorable value of 182 nm was obtained. On evaluating dishing as a conventional pad, a favorable value of 288 nm was obtained.

Example 66

A mixture comprising 30 wt % of powdered filter paper (E type) manufactured by ADVANTEK Co., Ltd. and 70 wt % of a mixture of 17 wt % of an epoxy resin, 13 wt % of a phenolic resin, and 70 wt % of fine silica particles 2 $\mu$m in diameter, was subjected to hot press molding at 185° C. using a 40-cm square mold. The dust adhesion test was performed on the thus obtained resin sheet.

As a result, 215 dust particles were found. The D hardness was 95 degrees. The polishing rate of oxide film was 162 nm/min. On evaluating dishing as fixed abrasive pad, a favorable value of 98 nm was obtained. On evaluating dishing as a conventional pad, a favorable value of 235 nm was obtained.

Comparative Example 13

A commercially available polishing pad ("IC-1000", a X-Y groove-processed product manufactured by Rodel Inc., was unfeasible in case of evaluating dishing as a fixed abrasive pad, because the steps remained as they are even after 10 minutes.

Example 67

A mixture comprising 30 wt % of powdered filter paper (E type) manufactured by ADVANTEK Co., Ltd., 5 wt % of a powder of barium carbonate (consisting of particles 60 nm in diameter), and 65 wt % of a mixture of 17 wt % of an epoxy resin, 13 wt % of a phenolic resin, and 70 wt % of fine silica particles 2 $\mu$m in diameter, was subjected to hot press molding at 185° C. using a 40-cm square mold. The dust adhesion test was performed on the thus obtained resin sheet.

As a result, 233 dust particles were found. The D hardness was 95 degrees. The polishing rate of oxide film was 165 nm/min. On evaluating dishing as fixed abrasive pad, a favorable value of 90 nm was obtained. On evaluating dishing as a conventional pad, a favorable value of 243 nm was obtained.

Comparative Example 14

The same procedures as described in Examples 65, and the pellets of polyhexamethyleneazipamide were subjected to hot press molding at 200° C. for fifteen minutes using a 40-cm square mold. The dust adhesion test was performed on the thus obtained resin sheet. As a result, 425 dust particles were found. The D hardness was 73 degrees. The polishing rate of oxide film was 80 nm/min. On evaluating dishing as a conventional pad, unfavorable value of 334 nm was obtained. Measurement was unfeasible in case of evaluating dishing as a fixed abrasive pad, because the steps remained as they are even after 10 minutes. (On the effect that the change in centerline average roughness Ra fall in a range of 0.2 μm or less)

Example 68

Two sheets of filter paper 17 chr produced by Whatman Corporation were superposed, and the resulting product was impregnated with liquid phenolic resin (PR-53123, a product of Sumitomo Durez K.K.) to yield a dry weight ratio of 50 wt %. After drying, the resulting product was shaped under pressure of 3.5 MPa at 170° C. for 20 minutes to obtain a sheet 1.8 mm in thickness. Thus obtained resin sheet was processed to a sheet 1.2 mm in thickness and having X-Y grooves processed thereon. Measurement of the centerline average roughness Ra was performed. As a result, Ra value after dressing was found to be 3.550 μm, the change after polishing single wafer was found to be 0.017 μm, and the change after polishing 5 wafers was found to be 0.019 μm. The D hardness was found to be 88 degrees. The polishing rate of the oxide film for the first wafer was found to be 62 nm/min, and that for the fifth wafer was found to be 63 nm/min. As a result, it has been found that the product maintains the polishing characteristics.

Example 69

A filter paper powder (E type) produced by ADVANTEK Co. Ltd. was uniaxially kneaded and compounded with "Surlyn" (1705, product of Mitsui DuPont Polychemicals, K.K.) at 165° C. in such a manner that the powder paper should account for 30% by weight. Pellets cut into 3 mm in length were hot pressed at 185° C. in a 40-cm square mold. Thus obtained resin sheet was processed to a sheet 1.2 mm in thickness and having X-Y grooves processed thereon. Measurement of the centerline average roughness Ra was performed. As a result, Ra value after dressing was found to be 2.550 μm, the change after polishing single wafer was found to be 0.112 μm, and the change after polishing 5 wafers was found to be 0.155 μm. The D hardness was found to be 63 degrees. The polishing rate of the oxide film for the first wafer was found to be 52 nm/min, and that for the fifth wafer was found to be 58 nm/min. As a result, it has been found that the product maintains the polishing characteristics.

Comparative Example 15

A 40-cm square "Axtar" (a product of Toray Industries, Inc.; a non-woven made of polyethylene terephthalate filaments, density 280 g/m$^2$) was impregnated with liquid phenolic resin (PR-53123, a product of Sumitomo Durez K.K.) at a dry weight ratio of 50 wt %, dried, and shaped at 170° C. for 20 minutes under pressure of 3.5 MPa to obtain a sheet 1.2 mm in thickness. Thus obtained resin sheet was subjected to X-Y groove processing, and the centerline average roughness Ra was measured. As a result, Ra value after dressing was found to be 3.355 μm, the change after polishing single wafer was found to be 0.402 μm, and the change after polishing 5 wafers was found to be 1.015 μm. The D hardness was found to be 90 degrees. The polishing rate of the oxide film for the first wafer was found to be 111 nm/min, and that for the fifth wafer was found to be 58 nm/min. As a result, it has been found unfeasible to maintain the polishing characteristics.

Example 70

A mixture comprising 30 parts of powdered filter paper (E type) manufactured by ADVANTEK Co., Ltd., 2 parts of polyvinylpyrrolidone (having a molecular weight of 10000), and 68 parts of PMMA (poly(methyl methacrylate)) was pelletized at 185° C., and shaped at 210° C. for 20 minutes under pressure of 3.5 MPa to obtain a sheet 1.2 mm in thickness. Thus obtained resin sheet was subjected to X-Y groove processing, and the centerline average roughness Ra was measured. As a result, Ra value after dressing was found to be 4.563 μm, the change after polishing single wafer was found to be 0.163 μm, and the change after polishing 5 wafers was found to be 0.177 μm. The D hardness was found to be 82 degrees. The polishing rate of the oxide film for the first wafer was found to be 91 nm/min, and that for the fifth wafer was found to be 88 nm/min. As a result, it has been found possible to maintain the polishing characteristics.

Comparative Example 16

A commercially available ABS resin sheet (a product of Toyo Plastic Seiko Co., Ltd., having a thickness of 1.2 mm) was subjected to X-Y groove processing, and the centerline average roughness Ra was measured. As a result, Ra value after dressing was found to be 4.952 μm, the change after polishing single wafer was found to be 0.699 μm, and the change after polishing 5 wafers was found to be 2.377 μm. The D hardness was found to be 80 degrees. The polishing rate of the oxide film for the first wafer was found to be 110 nm/min, and that for the fifth wafer was found to be 68 nm/min. As a result, it has been found unfeasible to maintain the polishing characteristics.

Comparative Example 17

A commercially available polishing pad ("IC-1000", a X-Y groove-processed product manufactured by Rodel Inc., 1.2 mm in thickness, 2.0 mm in width, and 0.5 mm in depth 15 mm in pitch) was subjected to the measurement of centerline average roughness Ra. As a result, Ra value after dressing was found to be 4.313 μm, the change after polishing single wafer was found to be 0.238 μm, and the change after polishing 5 wafers was found to be 0.863 μm. The D hardness was found to be 63 degrees. The polishing rate of the oxide film for the first wafer was found to be 113 nm/min, and that for the fifth wafer was found to be 88 nm/min. As a result, it has been found unfeasible to maintain the polishing characteristics.

(On the Effect of Water Absorptivity and the Rate of Water Absorption)

The evaluation results on dust adhesion and scratch flaw generation, water absorptivity and the rate of water absorption are given in Table 4.

Example 71

A varnish was prepared by dissolving 100 parts of a 95/5 mixture of an epoxy resin Epikote 180S65 (product of Yuka Shell Epoxy K.K.)/SR-GLG (product of Sakamoto Yakuhin K.K.) and 4 parts of a curing agent Epicure EMI-24 (product of Yuka Shell Epoxy K.K.) in methyl ethyl ketone. A craft paper (having nominal water content of 10%) 0.25 mm in thickness was impregnated with the varnish thus prepared at a dry resin weight ratio of 45 wt %. After drying, 6 sheets of the resulting product were shaped at 170° C. for 20 minutes under pressure of 1 MPa to obtain a sheet 1.2 mm in thickness.

Example 72

Two-part polyurethane resin KC-380 (product of Nippon Polyurethane Industry Co., Ltd.) and KN-585 (product of Nippon Polyurethane Industry Co., Ltd.) were kneaded at a weight ratio of 70 wt % and 30 wt %, respectively, and powdered filter paper (KC-FLOCK produced by Nippon Papermaking Industry Co., Ltd., 400-mesh size, having nominal water content of 11%) was further kneaded at a weight ratio of 25 parts by weight. After defoaming, the product was allowed to set inside the mold, and by cutting, 1.2 mm thick polyurethane sheet was produced.

Examples 73 to 77

Commercially available phenolic laminate sheets, FL-1041, FL-1051, FL-1065 (products of Nimura Kagaku Kogyo Co., Ltd.) and PS-1031S (Risho Kogyo Co., Ltd.), and paper epoxy laminate resin sheet ES-1192 (product of Risho Kogyo Co., Ltd.) were used to shape resin sheets 1.2 mm in thickness.

Evaluation was made on the order above.

Example 78

Two-part polyurethane resin KC-362 (product of Nippon Polyurethane Industry Co., Ltd.) and N-4276 (product of Nippon Polyurethane Industry Co., Ltd.) were kneaded at a weight ratio of 51 wt % and 49 wt %, respectively, and powdered filter paper (KC-FLOCK produced by Nippon Papermaking Industry Co., Ltd., 400-mesh size, having nominal water content of 11%) was further kneaded at a weight ratio of 25 parts by weight. After defoaming, the product was allowed to set inside the mold, and by cutting, 1.2 mm thick polyurethane sheet was produced.

Comparative Example 18

A 1.2 mm thick resin sheet was shaped by using a commercially available glass cloth epoxy laminate sheet ES-3350 (Risho Kogyo Co., Ltd.)

3. A polishing pad as claimed in claim 1, wherein the substantially water-insoluble hydrophilic polymer comprises particles or fibrous material having a water absorptivity of 5000% or lower.

4. A polishing pad as claimed in claim 3, wherein said particles or fibrous material are mixed in such a manner to account for 4 wt. % or higher but not higher than 60 wt. %.

5. A polishing pad as claimed in claim 1, wherein the substantially water-insoluble hydrophilic polymer is a sheet material, and comprises a laminate of a complex structure with an organic polymer matrix.

6. A polishing pad as claimed in claim 5, wherein the sheet material comprises at least one of non-woven, textile, woven, felt porous membrane, film, and sponge sheet.

7. A polishing pad as claimed in claim 5, wherein layers constituting a laminate have a thickness of 1 $\mu$m or more.

8. A polishing pad as claimed in claim 5, wherein the resin content or the type of the resin of the resin matrix differs from layer to layer.

9. A polishing pad as claimed in claim 7, wherein the thickness or the type of the sheet material differs from layer to layer.

10. A polishing pad as claimed in claim 5, wherein the sheet material accounts for 3 wt. % or more.

11. A polishing pad as claimed in claim 1, wherein the domain of a substantially water-insoluble hydrophilic polymer mixed in resin matrix comprises a fibrous material having an aspect ratio of 5 or higher or particles formed from a composite of the fibrous materials.

12. A polishing pad as claimed in claim 1, wherein the substantially water-insoluble hydrophilic polymer has nominal water content of 3% or higher.

13. A polishing pad as claimed in claim 1, wherein the domain of a substantially water-insoluble hydrophilic polymer mixed in a resin matrix is mixed in such a manner substantially free from interstices of the complex structure.

TABLE 4

| | | One-hour water absorptivity (%) | Water absorption rate in 5 minutes (%/hr) | Dust adhesion (counts) | Scratch flaws (counts) | Flexural Modulus of Elasticity (GPa) | D hardness (degrees) |
|---|---|---|---|---|---|---|---|
| Examples | 71 | 6.6 | 37.1 | 43 | 0 | 4.8 | 88.0 |
| | 72 | 1.9 | 6.7 | 69 | 1 | 1.8 | 75.0 |
| | 73 | 0.5 | 2.1 | 267 | 2 | 5.6 | 89.0 |
| | 74 | 0.6 | 2.2 | 245 | 2 | 5.4 | 89.0 |
| | 75 | 0.7 | 2.6 | 229 | 1 | 5.2 | 89 |
| | 76 | 0.5 | 1.8 | 251 | 2 | 7.8 | 90 |
| | 77 | 0.2 | 0.9 | 277 | 2 | 10.2 | 90 |
| | 78 | 0.3 | 1.0 | 271 | 2 | 1.9 | 77 |
| Comp Ex. | 18 | 0.1 | 0.3 | Uncountable | Uncountable | 12 | 92 |

INDUSTRIAL APPLICABILITY

The present invention reduces the scratch flaws and the dust adhesion that generate on the surface of the object to be polished, while increasing the polishing rate and minimizing dishing and erosion. Hence, the present invention is applicable to the field of surface polishing of semiconductor thin films.

What is claimed is:

1. A polishing pad comprising a resin matrix having a domain of a substantially water-insoluble hydrophilic polymer dispersed therein.

2. A polishing pad as claimed in claim 1, wherein the substantially water-insoluble hydrophilic polymer comprises a domain structure having an area of $1\times10^{-6}$ $m^2$ or smaller.

14. A polishing pad as claimed in claim 1, wherein the matrix constituting the pad is made of a thermosetting resin.

15. A polishing pad as claimed in claim 1, wherein the pad has interstices in addition to the domain of a substantially water-insoluble hydrophilic polymer mixed in a resin matrix.

16. A polishing pad as claimed in claim 1, wherein the pad comprises inorganic fine particles.

17. A polishing pad as claimed in claim 1, wherein the pad comprises organic-inorganic nanocomposite and/or barium carbonate particles.

18. A polishing pad as claimed in claim 17, wherein the organic-inorganic nanocomposite is at least one selected from a combination of a phenolic resin and silica particles, a combination of an epoxy resin and silica particles, and a combination of a polyamide resin and silica particles.

19. A polishing pad as claimed in claim 1, wherein the pad further comprises a water-soluble substance.

20. A polishing pad as claimed in claim 19, wherein the water-soluble substance accounts for 0.01 wt % to 10 wt %.

21. A polishing pad as claimed in claim 1, wherein the pad has a D hardness of 65 or higher.

22. A polishing pad as claimed in claim 1, wherein the pad has a flexural modulus of elasticity of 0.5 GPa or higher but not higher than 100 GPa.

23. A polishing pad as claimed in claim 1, wherein the pad has a one-hour water absorptivity of 0.8% or higher but not higher than 15%.

24. A polishing pad as claimed in claim 1, wherein the pad has a water absorption rate within 5 minutes from contact with water is 3%/hr or higher.

25. A polishing apparatus comprising a polishing pad claimed in claim 1.

* * * * *

UNITED STATES PATENT AND TRADEMARK OFFICE

CERTIFICATE OF CORRECTION

PATENT NO. : 6,953,388 B2
DATED : October 11, 2005
INVENTOR(S) : Shimagaki et al.

It is certified that error appears in the above-identified patent and that said Letters Patent is hereby corrected as shown below:

Column 21,
Line 65, change "(>m)" to -- µm --.

Signed and Sealed this

Twenty-fifth Day of April, 2006

JON W. DUDAS
*Director of the United States Patent and Trademark Office*